US009457382B2

(12) United States Patent
Dillon

(10) Patent No.: US 9,457,382 B2
(45) Date of Patent: Oct. 4, 2016

(54) SOIL SORTING SYSTEM

(71) Applicant: ISO-Pacific Nuclear Assay Systems, Inc., Richland, WA (US)

(72) Inventor: Michael John Dillon, Richland, WA (US)

(73) Assignee: ISO-PACIFIC NUCLEAR ASSAY SYSTEMS, INC., Richland, WA (US)

( * ) Notice: Subject to any disclaimer, the term of this patent is extended or adjusted under 35 U.S.C. 154(b) by 0 days.

(21) Appl. No.: 14/526,298

(22) Filed: Oct. 28, 2014

(65) Prior Publication Data

US 2016/0114357 A1 Apr. 28, 2016

Related U.S. Application Data

(63) Continuation of application No. PCT/JP2014/066249, filed on Jun. 19, 2014.

(51) Int. Cl.
*B07C 5/00* (2006.01)
*B07C 5/346* (2006.01)
*B07C 5/36* (2006.01)

(52) U.S. Cl.
CPC ..... *B07C 5/346* (2013.01); *B07C 5/362* (2013.01)

(58) Field of Classification Search
CPC ..... B07C 5/34; B07C 5/342; B07C 5/3425
USPC ..... 209/546, 552, 576
See application file for complete search history.

(56) References Cited

U.S. PATENT DOCUMENTS 5,038,040 A * 8/1991 Funk ..... G01N 21/3563 250/339.02
5,133,901 A * 7/1992 Peterson ..... G01N 23/12 209/3.2
5,522,512 A * 6/1996 Archer ..... B07C 5/342 209/580
6,484,886 B1 * 11/2002 Isaacs ..... B65G 43/08 198/368

(Continued)

FOREIGN PATENT DOCUMENTS

JP 2013-104743 5/2013
JP 2014-020909 3/2014

OTHER PUBLICATIONS

English Translation of International Search Report in International application No. PCT/JP2014/066249, mailed Dec. 14, 2014.

(Continued)

*Primary Examiner* — Terrell Matthews
(74) *Attorney, Agent, or Firm* — Davis Wright Tremaine LLP; Heather M. Colburn

(57) ABSTRACT

A sorting system for use with a feed material. The system includes a detector system, a control system, a diversion system, and a material transport mechanism. The material transport mechanism is configured to transport the feed material to the diversion system past the detector system. The detector system is operable to detect a level of a contaminant in the feed material transported past the detector system and transmit a signal to the control system indicating the level. The control system is operable to instruct the diversion system to deposit the feed material in a first area when the level exceeds predefined release criteria, and to deposit the feed material in a second area when the level does not exceed predefined release criteria. The feed material may include soil, concrete rubble, masonry rubble, ore, ash, metallic shapes, metallic scraps, and vegetable matter.

58 Claims, 12 Drawing Sheets

(56) References Cited

U.S. PATENT DOCUMENTS

| | | | | |
|---|---|---|---|---|
| 7,255,514 | B2 * | 8/2007 | Benjamin | B03B 9/02 405/128.75 |
| 8,100,581 | B2 * | 1/2012 | Djordjevic | B07C 5/344 374/122 |
| 2013/0292307 | A1 * | 11/2013 | Bamber | B07C 5/04 209/552 |
| 2014/0260801 | A1 * | 9/2014 | Wellwood | B07C 5/3427 75/392 |

OTHER PUBLICATIONS

English Translation of Written Opinion of the International Search Authority in International application No. PCT/JP2014/066249, mailed Dec. 20, 2015.

ISO-Pacific Nuclear Assay Systems, S3 Technology, Jul. 3, 2012, http://isopacific.net/technology.htm.

ISO-Pacific Nuclear Assay Systems, S3 Technology, Sep. 11, 2013, http://isopacific.net/technology.htm.

* cited by examiner

SOIL SORTING SYSTEM

CROSS-REFERENCE TO RELATED APPLICATIONS

The present application is a continuation of International Application No. PCT/JP2014/066249, filed on Jun. 19, 2014, designating the United States of America and published in Japanese on Dec. 24, 2014.

BACKGROUND OF THE INVENTION

1. Field of the Invention

The present invention is directed generally to systems and methods of detecting contamination in feed material (e.g., soil) and separating contaminated portions of the feed material from uncontaminated portions.

2. Description of the Related Art

Nuclear waste generators ship radioactive soil to expensive and highly regulated landfills for long-term storage and/or final disposal. Unfortunately, the cost of this type of disposal has increased over the years. Further, many landfills have closed, creating an ever-increasing demand for this type of storage.

Soils by contaminated by radionuclides are often heterogeneous having both clean and contaminated portions. Further, excavating a contaminated site typically mixes significant volumes of clean soil with contaminated soil. Therefore, a need exists for systems and methods that segregate or separate clean soil from contaminated soil thereby reducing the volume of waste in need of disposal and/or long-term storage. Because other types of materials, such as concrete rubble, masonry rubble, ores, ashes, metallic pieces, metallic scraps, vegetable matter, and other types of debris could also be partially contaminated, systems and methods configured to evaluate such materials would be particularly desirable. The present application provides these and other advantages as will be apparent from the following detailed description and accompanying figures.

BRIEF DESCRIPTION OF THE SEVERAL VIEWS OF THE DRAWING(S)

DETAILED DESCRIPTION OF THE INVENTION

Figure 1:
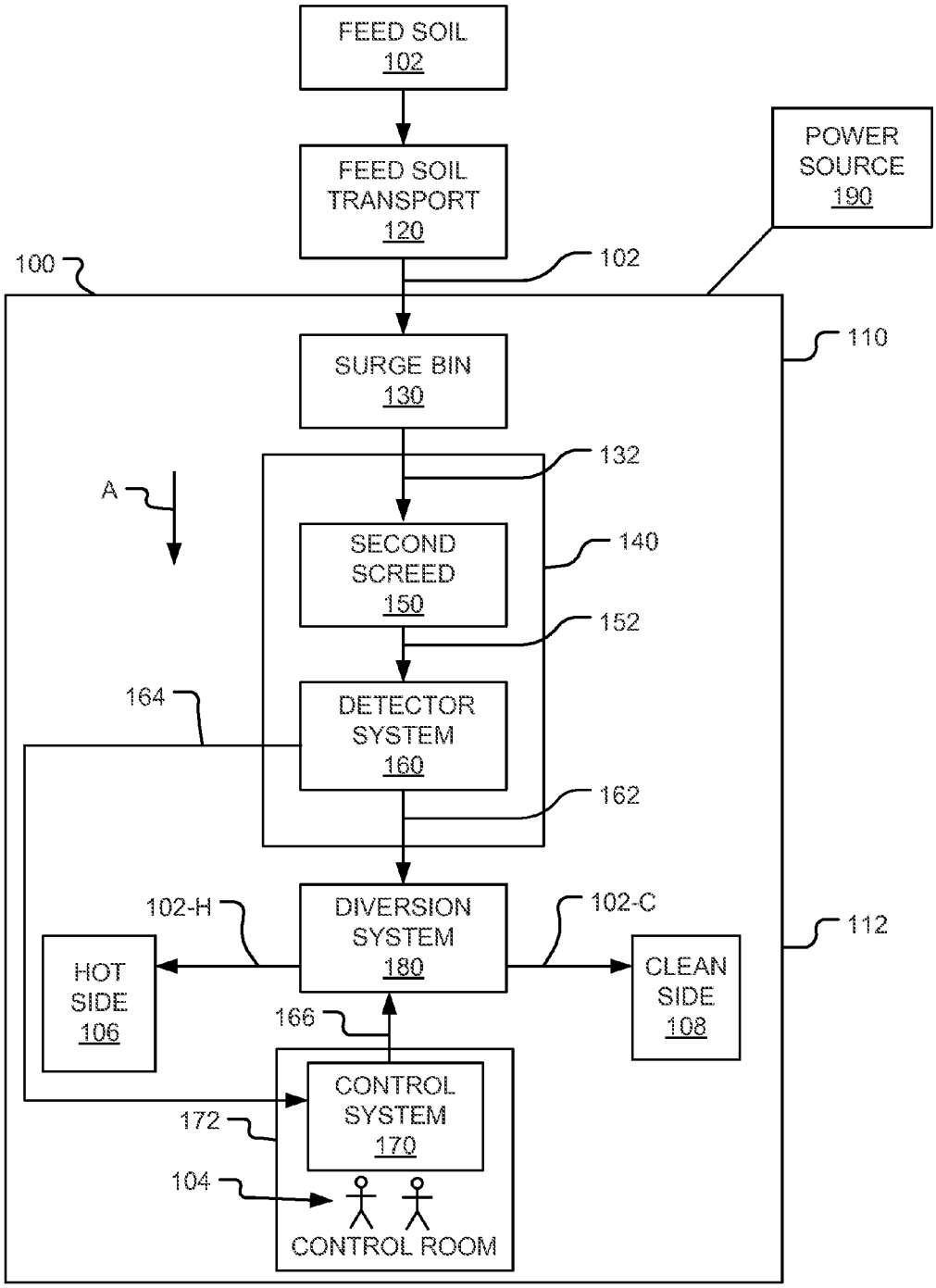
FIG. 1 is a block diagram of an exemplary system for surveying and sorting feed material (e.g., soil) to separate contaminated portions from uncontaminated portions.

FIG. 1 is a block diagram of a system 100 for surveying and sorting a feed material (e.g., feed soil 102) to separate contaminated portions (e.g., with one or more radioactive isotopes) from uncontaminated portions of the feed material. For ease of illustration, the feed material will be described and illustrated as being the feed soil 102. However, the feed material may include materials such as soil, concrete rubble, masonry rubble, ores, ashes, metallic shapes, metallic scraps, vegetable matter, other types of debris, combinations and subcombinations of the aforementioned materials, and the like. Further, the feed material may be either homogenous or heterogeneous.

The system 100 may be configured to separate soil contaminated with one or more radioactive isotopes from clean or uncontaminated soil by monitoring radioactive energies, if any, emitted by the feed soil 102. In alternate embodiments, the system 100 may be configured detect other types of soil contamination, such as contamination with elemental species, volatile organic compounds, and other type of materials. The system 100 may be operated by one or more operators 104.

The feed soil 102 enters the system 100 at a first (upstream) end portion 110 and travels toward a second (downstream) end portion 112. At the second (downstream) end portion 112, contaminated portions 102-H of the feed soil 102 exit the system 100 along a "hot" side 106 of the system 100, and uncontaminated or clean portions 102-C of the feed soil 102 exit the system 100 along a "clean" side 108 of the system 100.

The feed soil 102 is supplied to the system 100 by a feed soil transport 120, such as a conventional conveyor, earth hauling equipment, and the like. As will be described in further detail below, the system 100 includes a surge bin 130, which receives the feed soil 102 from the feed soil transport 120. The surge bin 130 supplies an initial soil stream 132 to a soil transport mechanism 140. The soil transport mechanism 140 transports the initial soil stream 132 to a second screed 150. The second screed 150 shapes the initial soil stream 132 into a pre-evaluation soil stream 152. The soil transport mechanism 140 transports the pre-evaluation soil stream 152 past a detector system 160 configured to collect data about the pre-evaluation soil stream 152. After the detector system 160 has gathered data about the pre-evaluation soil stream 152, the pre-evaluation soil stream 152 becomes an evaluated soil stream 162. The detector system 160 transmits information 164 about the pre-evaluation soil stream 152 to a control system 170, which may optionally be at least partially housed inside a control room 172. The soil transport mechanism 140 transports the evaluated soil stream 162 to a diversion system 180. The control system 170 sends instructions 166 to the diversion system 180. The instructions 166 direct the diversion system 180 to deposit the contaminated portions 102-H of the evaluated soil stream 162 along the "hot" side 106 of the system 100, and instructs the diversion system 180 to deposit the uncontaminated portions 102-C of the evaluated soil stream 162 along the "clean" side 108 of the system 100.

As shown in FIG. 1, the system 100 is connected to and receives power from a power source 190. The power source 190 may be a conventional 480 volt, 30 amp service, which is commonly available at many buildings and power poles. Alternatively, the power source 190 may be a mobile generator.

Figure 2A:
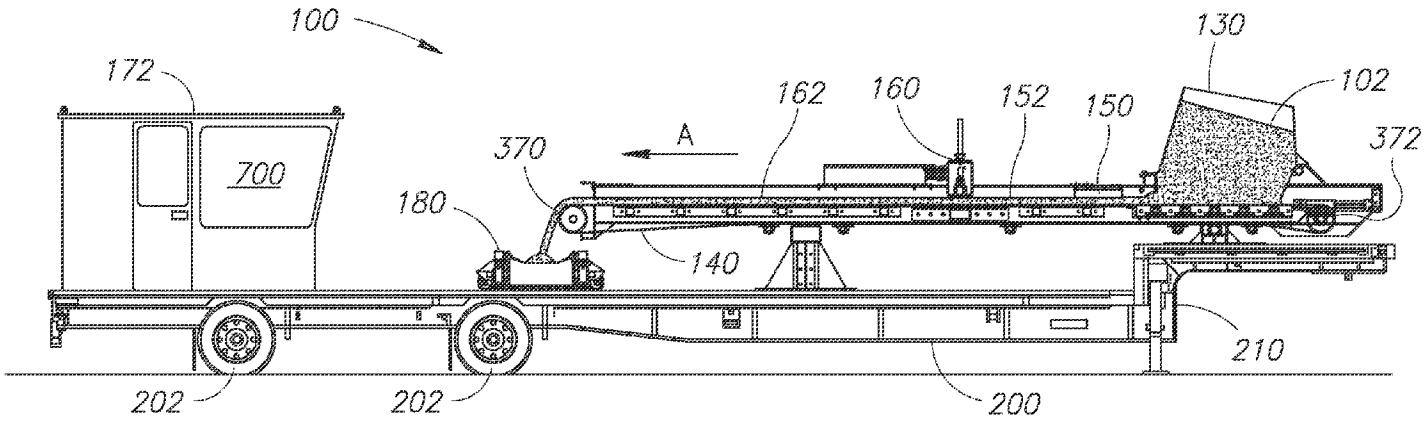
FIG. 2A is a side view of the system.

Referring to FIG. 2A, the system 100 may include a frame 200 upon which various system components illustrated in FIG. 1 may be mounted. The system 100 may be mobile or transportable. For example, the frame 200 may be supported by wheels 202. In such embodiments, the system 100 may be implemented on a mobile trailer 210 (e.g., a conventional flatbed trailer). The trailer 210 may be pulled onsite, and hooked up to the power source 190 (see FIG. 1). By way of a non-limiting example, the system 100 may be self-contained and constructed entirely on the trailer 210. The trailer 210 may be implemented using a 2009 Fontaine 53 feet long drop-deck trailer with steel 22.5" wheels. In the embodiment illustrated, the control room 172 is hard-mounted on the trailer 210.

Catwalk and stair components (not shown) may be loaded on and unloaded from the trailer 210 manually. The one or more operators 104 (see FIG. 1) may assemble a catwalk (e.g., along the soil transport mechanism 140 and/or other components of the system 100) and calibrate the detector system 160 (e.g., all in the same day). Cranes may not be needed to erect, load, and unload the system 100. Depending upon the implementation details, assembly may be completed within two working days.

While described as being mounted to the frame 200, those of ordinary skill in the art appreciate that one or more of the components of the system 100 may be separate from the frame 200. Selected components of the system 100 will now be described in detail below.

Feed Soil Transport

Figure 3A:
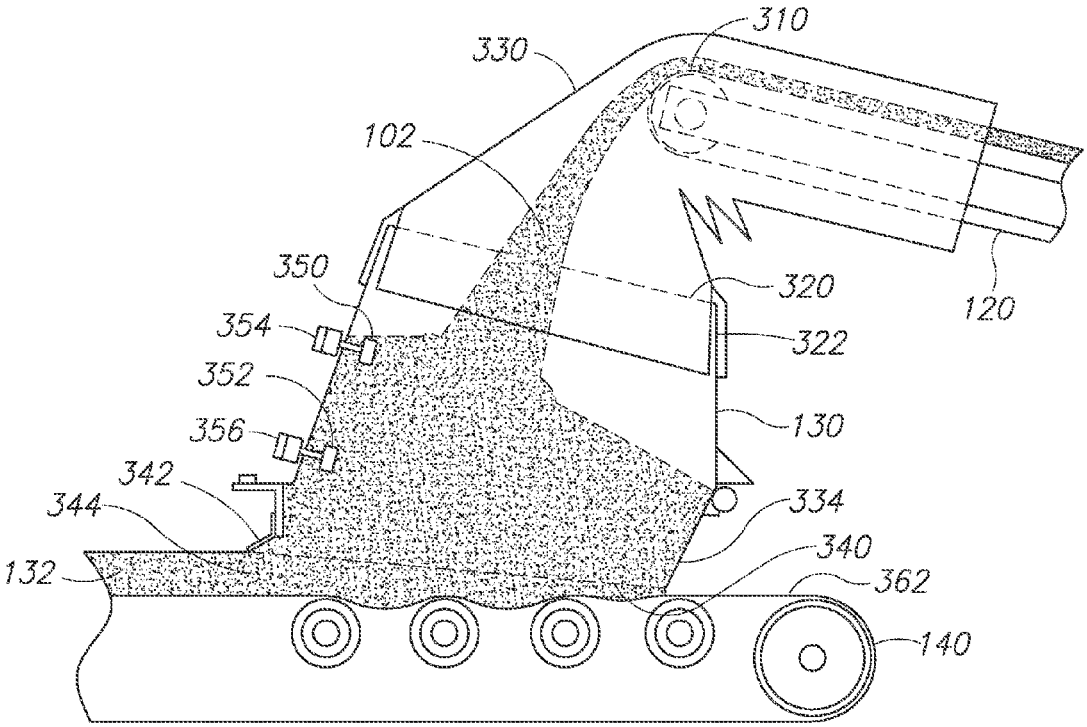
FIG. 3A is an enlarged side view of a surge bin subcomponent of the system.
Figure 3B:
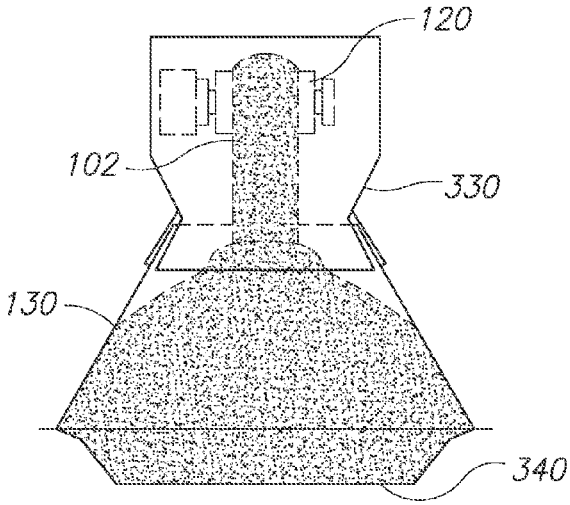
FIG. 3B is an enlarged front view of the surge bin of the system.

Referring to FIG. 1, as mentioned above, the feed soil 102 enters the system 100 via the feed soil transport 120. By way of a non-limiting example, the feed soil transport 120 may be implemented as a screen plant or stacker conveyor. For ease of illustration, in FIGS. 3A and 3B, the feed soil transport 120 has been illustrated and will be described as being a conveyor. Referring to FIG. 3A, a discharge end portion 310 (or head pulley end) of the feed soil transport 120 deposits the feed soil 102 into the surge bin 130.

Surge Bin

Referring to FIG. 3A, the surge bin 130 has an open upper portion 320 adjacent the discharge end portion 310 of the feed soil transport 120. The upper portion 320 of the surge bin 130 has an upper peripheral portion 322 that defines an upper opening 324 (see FIG. 3D). For dust protection, a sock 330 that envelops the discharge end portion 310 of the feed soil transport 120 may be attached (e.g., snapped) to the peripheral portion 322 of the open upper portion 320 of the surge bin 130. This arrangement may help keep dust inside the system 100 and out of the operator environment.

The surge bin 130 has an open lower portion 334 adjacent the soil transport mechanism 140. The lower portion 334 has a lower opening 340 positioned alongside the soil transport mechanism 140. The feed soil 102 enters the upper portion 320 through the upper opening 324 (see FIG. 3D), travels through the surge bin 130, and exits therefrom via the lower opening 340 onto the soil transport mechanism 140.

Figure 3C:
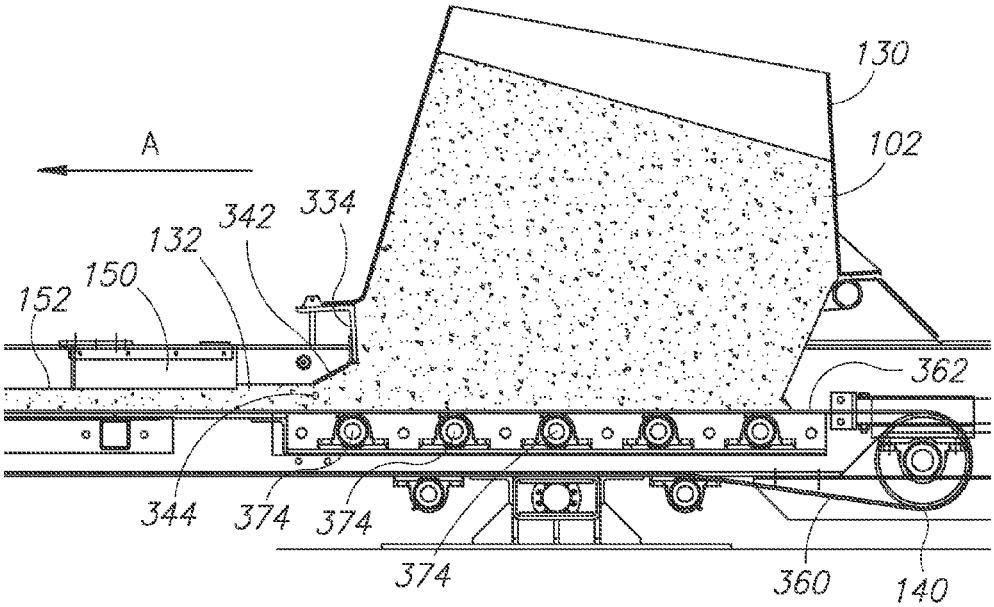
FIG. 3C is an enlarged portion of FIG. 2A.

The surge bin 130, which is configured to handle varying soil conditions, shapes the feed soil 102 into a flat, wide stream in preparation for survey by the detector system 160 (see FIG. 1). Soil shaped by the surge bin 130 is deposited onto the soil transport mechanism 140 as the initial soil stream 132. Referring to FIG. 3C, the lower portion 334 of the surge bin 130 includes a first screed 342. An opening 344 is defined between the first screed 342 and the soil transport mechanism 140. Optionally, the surge bin 130 may be configured to adjust the height of the first screed 342 to adjust the thickness of the initial soil stream 132.

Figure 3D:
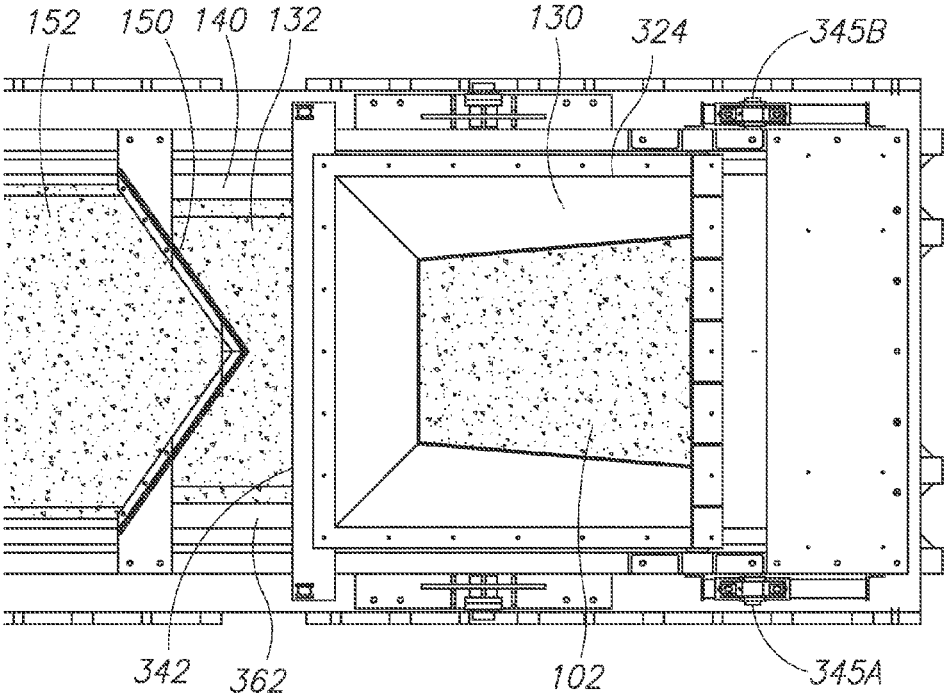
FIG. 3D is an enlarged portion of FIG. 2B.
Figure 3E:
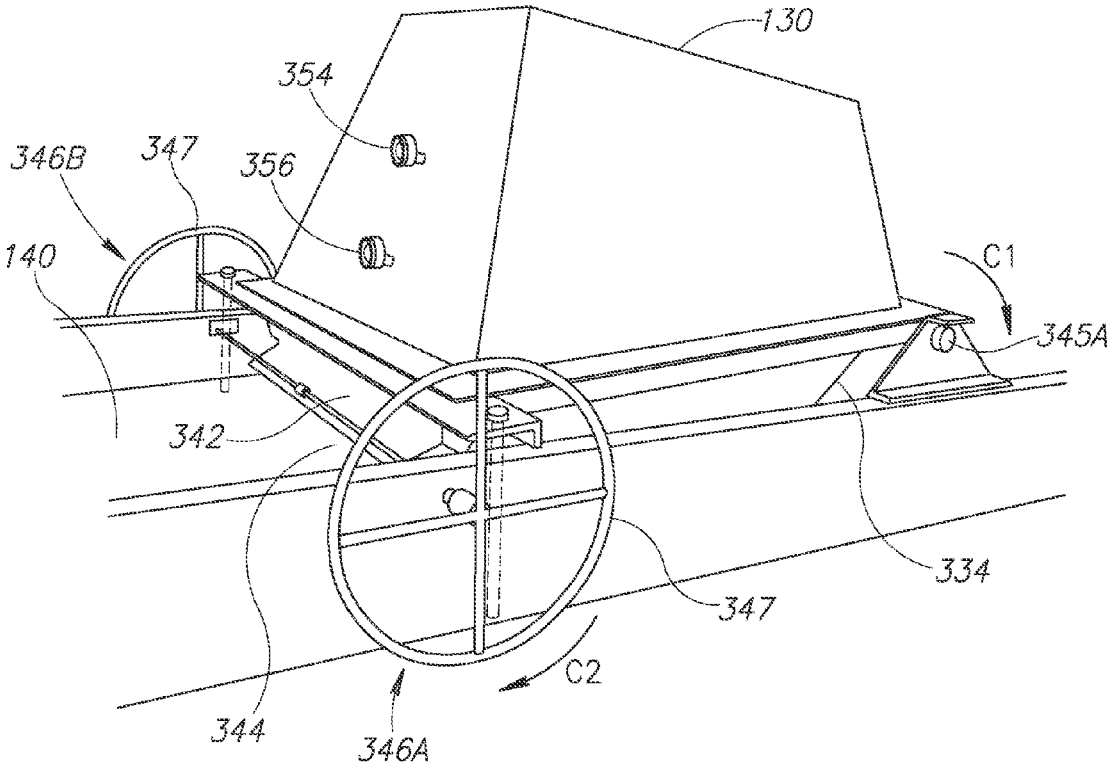
FIG. 3E is a perspective view of the front of the surge bin.

For example, referring to FIG. 3D, the surge bin 130 may be pivotably mounted above the soil transport mechanism 140 by a pair of pivot pins 345A and 345B. Further, the surge bin 130 may be equipped with height adjustment mechanisms 346A and 346B (e.g., screw jacks and hand wheels) configured to allow the operators 104 (see FIG. 1) to raise and lower the front of the surge bin 130. Raising the front of the surge bin 130 causes the surge bin to rotate about the pivot pins 345A and 345B in a direction identified by arrow C1. On the other hand, lowering the front of the surge bin 130 causes the surge bin to rotate about the pivot pins 345A and 345B in a direction opposte the direction identified by arrow C1. Rotating the surge bin 130 about the pivot pins 345A and 345B, adjusts the height of the first screed 342, which adjusts the height of the opening 344 through which the initial soil stream 132 exits the surge bin 130. By increasing the distance between the first screed 342 and the soil transport mechanism 140, the initial soil stream 132 exiting the surge bin 130 may be made thicker. By way of a non-limiting example, the height adjustment mechanisms 346A and 346B may be implemented as screw jacks (e.g., model number Model 1-MSJ-DC 5; 1/SSE-1SSE-2/CC/S available from NOOK Industries, Inc.). The height adjustment mechanisms 346A and 346B may each include a rotatable handwheel 347. In the embodiment illustrated, when the rotatable handwheels 347 are rotated manually in a direction identified by arrow C2, the front of the surge bin 130 is raised by the height adjustment mechanisms 346A and 346B. On the other hand, when the rotatable handwheels 347 are rotated manually in a direction opposite the direction identified by the arrow C2, the front of the surge bin 130 is lowered by the height adjustment mechanisms 346A and 346B.

Referring to FIG. 3A, the surge bin 130 may include one or more (e.g., two) fail-safe rotary bin level indicators 350 and 352 configured to illuminate stacklights 354 and 356, respectively, mounted on the outside of the surge bin 130. The stacklights 354 and 356 are positioned to be observable by the operators 104 (see FIG. 1) in the control room 172 (see FIG. 2A) and help keep the operators aware of the level of the feed soil 102 inside the surge bin 130. In the embodiment illustrated, the surge bin 130 has a three cubic yard capacity. Optionally, an LED spotlight (not shown) may be mounted on the surge bin 130 to illuminate the initial soil stream 132 during nighttime operations.

Referring to FIG. 2A, optionally, the surge bin 130 may be lifted off and separated from the frame 200. For example, the surge bin 130 may be secured to the frame 200 by bolts and/or shear pins. In such embodiments, the surge bin 130 may be removed from the frame 200 by removing the bolts and/or shear pins. The surge bin 130 may be configured to rotate (e.g., by 90 degrees) vertically for decontamination egress, if necessary.

The surge bin 130 is shaped to allow the feed soil 102 to travel towards areas of decreasing pressure, both horizontally and vertically. This helps keep plastic soils flowing without compacting and/or sticking to the inside of the surge bin 130. Referring to FIG. 3A, the lower portion 334 may be characterized as being tapered inwardly toward the lower opening 340. Further, the lower portion 334 of the surge bin 130 may be shaped such that it widens from upstream to downstream, in both the horizontal and vertical directions. This allows soil to travel towards an area of decreasing pressure, which helps keep the feed soil 102 moving through and flowing out of the surge bin 130.

The upper portion 320 of the surge bin 130 may be characterized as being tapered outwardly from the upper opening 324 toward the lower portion 334. Thus, the upper portion 320 has a generally a pyramid-like shape, which is in direct contrast to other bins typically used for this purpose. The pyramid-like shape allows the feed soil 102 therein to assume a natural angle of repose inside the surge bin 130, instead of requiring that the bin support the feed soil 102. Because conventionally shaped surge bins support the soil inside the bin, the soil tends to form bridges at the bottom of the bin. This bridging causes the soil to stop flowing out of the bin, which can create major problems for the sorting process.

Soil Transport Mechanism

Referring to FIG. 2A, the soil transport mechanism 140 transports a substantially continuous stream of feed soil having a substantially uniform and predetermined thickness from the second screed 150 past (e.g., under) the detector system 160. Referring to FIG. 3C, for ease of illustration, the soil transport mechanism 140 has been illustrated and will be described as being a main conveyor 360 with a main conveyor belt 362. However, through application of ordinary skill in the art to the present teachings alternate structures may be used to transport and present soil to the detector system 160.

The main conveyor belt 362 travels in a direction (identified by an arrow "A") from the first (upstream) end portion 110 (see FIG. 1) of the system 100 toward the second (downstream) end portion 112 (see FIG. 1) of the system 100. For ease of illustration, the direction (identified by the arrow "A") will be described as transporting soil from "upstream" to "downstream."

In the embodiment illustrated, the main conveyor 360 has been implemented as a flat, wide conveyor configured to accommodate a layer of feed soil up to about six inches deep. In such embodiments, the main conveyor belt 362 may be a wide belt configured to provide high production rates at very slow belt speeds. Depending on the belt speed and soil layer thickness, production volumes may range up to about 200 cubic yards ("cy") per hour. However, about 60 cy/hr to about 120 cy/hr may be more common and may function well with most contractors' equipment capabilities and logistical patterns.

By way of a non-limiting example, the main conveyor belt 362 may be implemented using a BeltFab WM2-220 3×1 ply 72 inches wide composite rubber/plastic conveyor belt. The main conveyor belt 362 may include fabric faced on its inside surface to provide high traction capability when loaded. Mechanical splices (or seams) may allow soil to "sift" through a conveyor belt, which is undesirable. To avoid this problem, all conveyor belts (e.g., the main conveyor belt 362) used in the system 100 may be seamless. By way of a non-limiting example, field-vulcanizing may be used to construct a seamless conveyor belt.

Figure 2B:
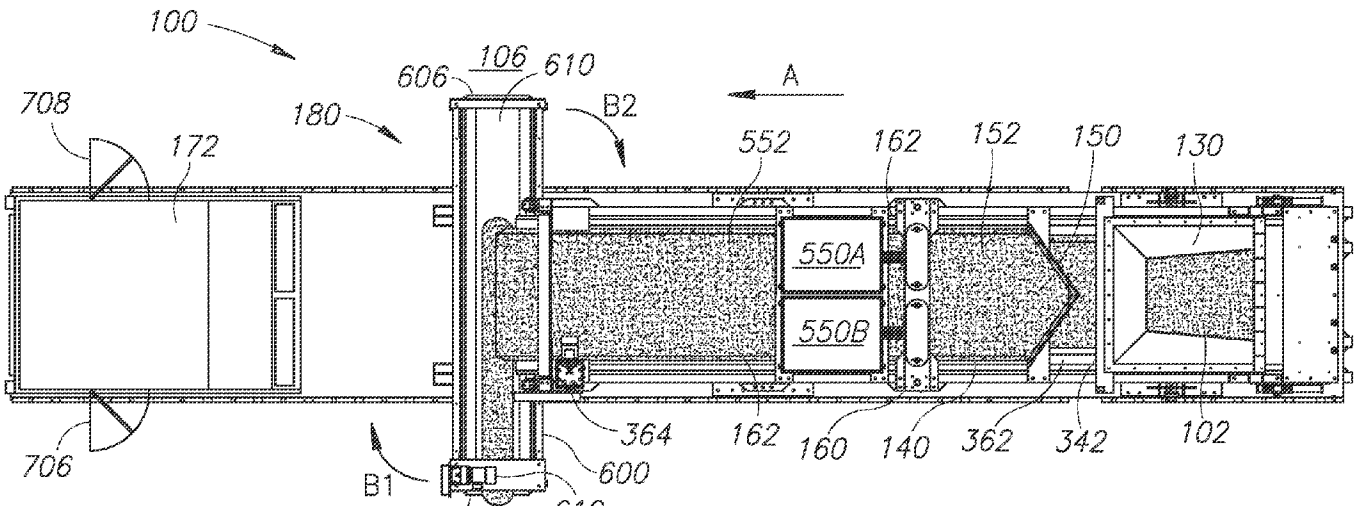
FIG. 2B is a top view of the system.

Referring to FIG. 2B, the main conveyor 360 is driven by at least one drive motor 364. By way of a non-limiting example, the drive motor may be implemented as a serially controlled Nord SK63-100L/4 CUS-TI 0/1 S SK300E-221-340-B gear motor with a motor-mounted "Trio" inverter. In such implementations, the drive motor may optionally include a SK CU2-STD P/N 75130020 interface and a SK300E 101-300E communications cable.

Referring to FIG. 2A, the main conveyor belt 362 may include a drive or head pulley 370 (see FIG. 2A). By way of a non-limiting example, the head pulley 370 may be implemented using a PPI 12.0×75.0 drive pulley with PPI XT40B 3 15/16" bushings and one-half inch of applied SBR 60 rubber lagging. The head pulley 370 may use a solid 3 15/16" shaft necked down to accommodate Browning four-bolt PBE920F 3 7/16" bore pillow blocks. These head pulley blocks may be mounted directly to the frame 200 of the system 100.

The main conveyor 360 may include a tail pulley 372. By way of a non-limiting example, the tail pulley 372 may be implemented using a PPI 12.0×75.0 smooth crowned pulley with PPI XT35B 3 7/16" bushings. The tail pulley 372 may use a solid 3 7/16" shaft necked down to accommodate Browning two-bolt PBE920X 2 15/16" bore pillow blocks. These tail pulley blocks may be mounted to the frame 200 by specially configured take-up frames (e.g., Bryant Telescoper 400-TM-12-MS-SF-BP-57004).

Referring to FIG. 3C under the surge bin 130, the main conveyor 360 may include live shaft impact idlers 374 (e.g., PPI D5-39LSI-72). These idlers 374 absorb the shock of the feed soil 102 onto the main conveyor belt 362 when the surge bin 130 is charged (or filled). The idlers 374 may be solid shaft and supported by roller bearing pillow blocks (e.g., Browning PBE920 2 3/16").

Referring to FIG. 2A, beyond the surge bin 130, the soil-bearing portion of the main conveyor belt 362 may be supported by sheeting mounted on steel cross-members of the frame 200. By way of a non-limiting example, the sheeting may be REDCO ½" thick ultra-high molecular weight polyethylene. Such construction is often referred to as a "slider bed." Underneath, the empty return side of the main conveyor belt 362 may be supported by a series of live shaft impact idlers (e.g., PPI D5-39LSI-72) that function as traditional lightweight return idlers. The idlers may be solid shaft and suspended by roller bearing pillow blocks (e.g., Browning PBE920 2 3/16").

Referring to FIG. 2B, the main conveyor 360 may be equipped with primary conveyor belt cleaning systems (not shown). Such systems may include tensioned scraper systems that provide a scraper configured to scrape material from the belt 362. The scraper may be constructed with a knife-edge of polymeric material or metal. The scraper may be positioned on or against the surface of the belt 362 at or near the head pulley or underneath the belt. The scraper scrapes mud (called carryback), ice, or snow build-up from the belt 362. Secondary scrapers positioned under the belt 362 may also be used to help minimize carryback.

Second Screed

Referring to FIG. 2B, the initial soil stream 132 leaving the surge bin 130 (via the soil transport mechanism 140) may not have a desired thickness and/or the width for proper evaluation (e.g., radioassay) by the detector system 160. For example, the initial soil stream 132 may be slightly thicker than is required. The soil transport mechanism 140 transports the initial soil stream 132 to the second screed 150, which acts as a finishing "shaper," and further shapes the initial soil stream 132 into the pre-evaluation soil stream 152 having a predetermined thickness. In other words, the second screed 150 strikes the initial soil stream 132 to the predetermined thickness. The thickness of the pre-evaluation soil stream 152 may depend at least in part on the isotope of concern and its attenuation characteristics in a specific soil type.

Referring to FIG. 3D, the second screed 150 may have a plow-like or chevron-like shape configured to direct soil toward the outside edges of the main conveyor belt 362, which widens the pre-evaluation soil stream 152. Thus, the height of the first screed 342, and the height of the second screed 150 define the thickness and the width of the pre-evaluation soil stream 152.

By way of a non-limiting example, the second screed 150 may be at least partially constructed from ½ inch thick REDCO ultra-high molecular weight polyethylene "plow boards" that shed soil and moisture while in contact with the initial soil stream 132. These plow boards may be configured to create desired soil stream geometry (e.g., the width and/or the depth).

Detector System

Referring to FIG. 2A, the soil transport mechanism 140 passes the pre-evaluation soil stream 152 under the detector system 160. Below the soil transport mechanism 140 (e.g., below the main conveyor belt 362) and directly under the detector system 160, the system 100 may include a shadow shield (not shown) configured to help prevent photon emissions, from areas below the system 100, from reaching the detector system 160. The shadow shield (not shown) may be implemented as a large, flat steel plate.

The detector system 160 collects data from the portion of the pre-evaluation soil stream 152 passing underneath the detector system 160. Software algorithms executed by the control system 170 determine whether the soil portion exceeds predefined release criteria. Those portions of the evaluated soil stream 162 that exceed the predefined release criteria (referred to as "contaminated soil") are identified and flagged to be mechanically separated from soil that does not exceed the predefined release criteria (referred to as "clean soil"). The control system 170 may instruct the diversion system 180 to mechanically separate the contaminated portion 102-H (see FIG. 1) from the clean portion 102-C (see FIG. 1) of the evaluated soil stream 162.

Figure 4A:
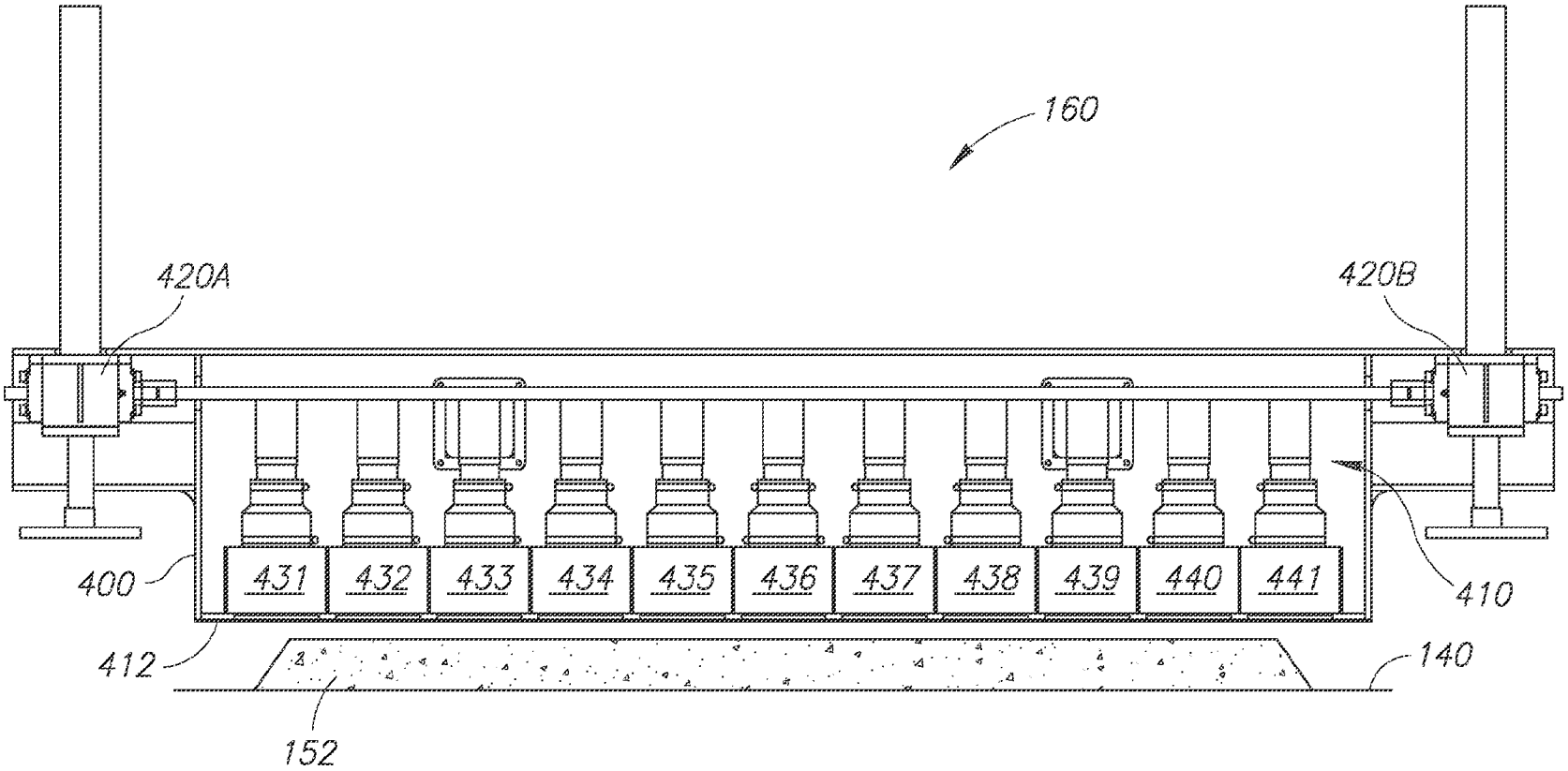
FIG. 4A is an enlarged view of a detector array positioned inside a housing of a detector system subcomponent of the system.

Referring to FIG. 4A, the detector system 160 includes a housing 400 and a detector array 410 linked to the control system 170 (see FIG. 1). The housing 400 is positioned directly above the soil transport mechanism 140 and has a face 412 adjacent one or more detector windows 414 (see FIG. 4B) each facing the pre-evaluation soil stream 152 on the soil transport mechanism 140 under the housing 400.

By way of a non-limiting example, the housing 400 may be implemented as a box that is about 12 inches wide, about 16 inches tall, and about 7 feet and 7 inches long constructed from steel having a thickness of about ⅜ inches. The detector array 410 may be temperature controlled (kept at a substantially constant temperature) inside the housing 400.

The housing 400 may be supported by one or more height adjustment mechanisms 420A and 420B (e.g., screw jacks coupled to shafts). By way of a non-limiting example, the height adjustment mechanisms 420A and 420B may be implemented as a pair of shaft-coupled screw jacks (e.g., model number 5-MSJ-I 6; 1/SSE-2/FP/24/S available from NOOK Industries, Inc.). The height adjustment mechanisms 420A and 420B may have a five-ton capacity and may be configured to be actuated with a handheld drill motor (not shown). The height adjustment mechanisms 420A and 420B may be used to adjust the height of the housing 400 relative to the soil transport mechanism 140. In particular embodiments, the height adjustment mechanisms 420A and 420B may be configured to finely adjust the distance between the housing 400 and the pre-evaluation soil stream 152. Thus, the height adjustment mechanisms 420A and 420B may be used to position the housing 400 at a desired distance to provide a satisfactory field of view (e.g., as defined by testing conducted by one or more modeling and calibration software programs 728 (see FIG. 5) such as In-Situ Object Counting System ("ISOCS") software). By way of a non-limiting example, the distance between the surface of the pre-evaluation soil stream 152 and the face 412 of the housing 400 may be less than one inch. The height adjustment mechanisms 420A and 420B may be configured to allow the operators 104 (see FIG. 1) to raise the housing 400 (e.g., up to 22 inches above the soil transport mechanism 140) to clean the portions of the face 412 adjacent the detector windows 414 (see FIG. 4B) as needed. When used with support blocks (not shown), the housing 400 can be raised and lowered back to its original height without voiding the calibration geometry.

Figure 4B:
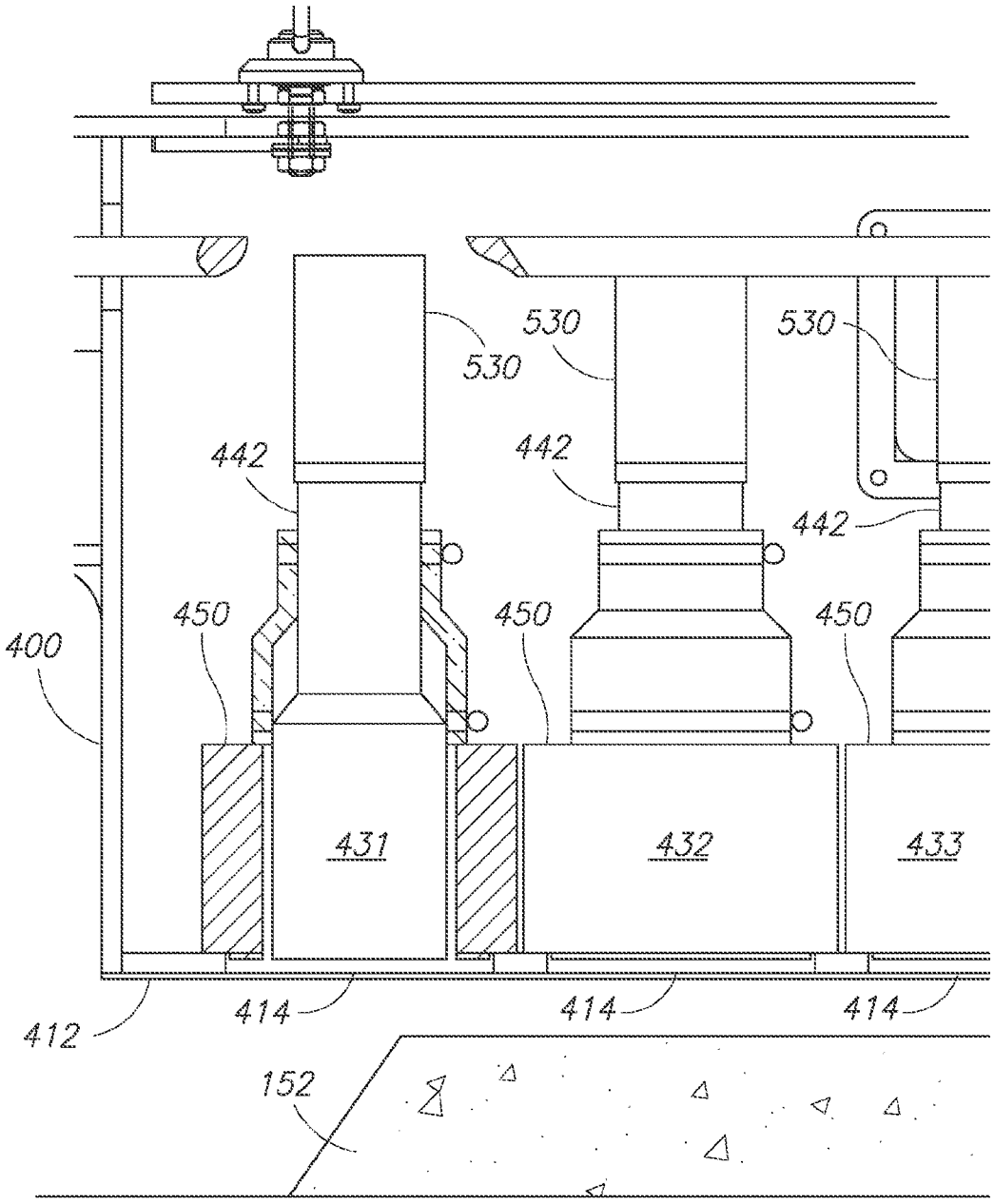
FIG. 4B is an enlarged view of a portion of the detector array including a partial sectional view of a leftmost detector subassembly.
Figure 4C:
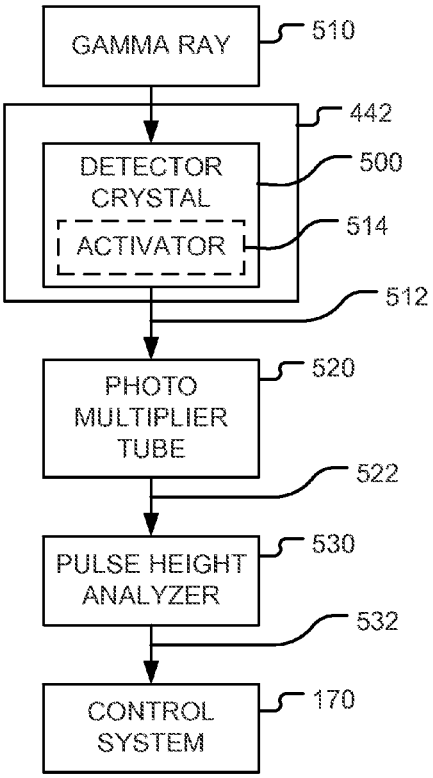
FIG. 4C is a block diagram illustrating an exemplary detector subassembly detecting a gamma ray.

The detector array 410 includes a plurality of detector subassemblies 431-441. Referring to FIG. 4B, each of these subassemblies 431-441 may include a radiation detector 442. For ease of illustration, each of the radiation detectors 442 will be described as being a sodium iodide (NaI) radiation detector configured to determine an amount of radioactivity present. NaI detectors are scintillation detectors. Thus, referring to FIG. 4C, each of the radiation detectors 442 may include a detector crystal 500. When a gamma ray 510 enters the detector crystal 500, electronic interactions inside the crystal 500 can cause light 512 to be emitted from the crystal. The amount of light emitted is proportional to the energy of the gamma ray 510. The light 512 may include one or more light flashes. To shift the frequency of the emitted light to a range detectable by most photo multiplier tubes, an optional activator 514 (e.g., 0.1% thallium) may be doped into the crystal 500. Such NaI detectors may more properly be referred to as NaI(Tl) detectors.

The light 512 is detected by a photo multiplier tube ("PMT") 520 coupled to the radiation detector 442. The PMT 520 converts the light 512 into an electrical signal 522, which in turn is analyzed by a pulse height analyzer 530. The electrical signal 522 includes a series of voltage pulses. The intensity of these voltage pulses is proportional to the energy of the gamma-ray photon(s) that initiated the voltage pulses. The pulse height analyzer 530 determines a number of pulses having a predetermined height detected in a predetermined amount of time (referred to as a "pulse count value"). The pulse height analyzer 530 may be implemented as a multichannel pulse height analyzer ("MCA").

The pulse height analyzer 530 transmits a signal 532 encoding the pulse count value to the control system 170. Thus, as the pre-evaluation soil stream 152 travels past the detection system 160, the pulse height analyzer 530 periodically sends a new pulse count value to the control system 170 encoded in the signal 532. In this manner, the control system 170 receives a different signal 532 from each of the detector subassemblies 431-441, and each of those signals encodes a series of pulse count values. Together these signals 532 (each encoding a series of pulse count values) form at least part of the information 164 (see FIG. 1) transmitted by the detector system 160 to the control system 170.

As will be described below, the control system 170 processes the signals 532, determines whether a portion of the feed soil 102 associated with particular pulse count values in the signals 532 is clean or contaminated, instructs the diversion system 180 (see FIGS. 1 and 2B) to transport the portion of the feed soil to either the "hot" side 106 or the "clean" side 108 of the system 100, and optionally displays information (e.g., count rates and/or spectrographs) to the operators 104.

NaI detector crystals are available in many different sizes and shapes. The size and shape used affects the performance of the detector subassemblies 431-441 (see FIG. 4A). In general, the larger the crystal, the more gamma rays from a given source will be converted into light. The thickness of the crystal also affects the efficiency of the absorption of gamma rays of various energies. For instance, high-energy gamma rays may pass completely through a thin crystal, a property that is exploited in thin NaI detectors like a Field Instrument for Detection of Low Energy Radiation (FIDLER). The system 100 can use such detectors to detect low-energy gamma rays at high efficiency, since most high-energy gamma rays will pass through the crystal undetected. Such an embodiment reduces background noise from high-energy gamma rays and improves the detection of radionuclides with low-energy gamma rays.

Conversely, thick detector crystals may be used to detect uranium, radium, and thorium isotopes that have prominent high-energy gamma rays. By detecting widely spaced gamma rays, thick detector crystals can be used to resolve the progeny of uranium-238 ("U-238"), radium-226 ("Ra-226"), and thorium-232 ("Th-232"), all common naturally occurring radioactive materials (NORM). The progeny of these nuclides are used in their detection. Usually, many mutually interfering gamma rays may be present and must be accounted for in the calibration process. Therefore, it may be advantageous to use a MCA with NaI detectors each having a crystal that is about three inches by three inches because such a system is cable of differentiating between interfering gamma ray peaks.

The system 100 may be configured to use different types of scintillation detectors (e.g., NaI or bismuth germanium oxide ("BGO") detectors). Scintillating crystal detectors may be useful for performing scanning surveys for several reasons. For example, they are sensitive, rugged, inexpensive, and require no detector cooling.

Referring to FIG. 4B, a collimator well 450 surrounds each of the radiation detectors 442. Each of the collimator wells 450 may be generally cylindrical in shape and open at both ends. Each of the collimator wells 450 may be implemented as a machined tungsten collimator well. The collimator wells 450 are placed inside the housing 400, and their shape and density is used to lower background radiation count rates and to restrict radiation entering the radiation detectors 442 to only that from an area located directly below the collimator wells 450. The collimator wells 450 may each be about an inch thick, and provide the same radiation shielding as about 2.25 inches of lead. The collimator wells 450 may be tall enough (e.g., have a height of about 4 inches) to shield the crystal 500 (when the crystal is about three inches by three inches) inside the radiation detector 442 from radiation traveling horizontally. Horizontally traveling radiation may originate from nearby soil piles and/or from the soil inside the surge bin 130.

After the radiation detector 442, referring to FIG. 2B, the evaluated soil stream 162 may pass under one or more of electrical cabinets (e.g., a first electrical cabinet 550A, and a second electrical cabinet 550B), and/or open space (e.g., open space 552) reserved for other types of detection systems (not shown). In the embodiment illustrated, the electrical cabinets 550A and 550B are mounted downstream from the detector system 160. The electrical cabinet 550A is used as an enclosure for miscellaneous electrical power, and the electrical cabinet 550B houses a relay card and a single-channel Nuclear Instrumentation Modules ("NIM") bin, which is an optional method of radiation detection by the system 100, typically used where only a single radiation energy is present and no spectroscopy is desired.

Many sites have collocated chemical and radiological contamination in soil. The presence of collocated radiological and chemical waste usually presents special challenges from a waste disposal perspective (i.e., separating low-level radiologically contaminated media from mixed waste streams or waste that has only chemical contamination). Because it is so much more expensive to dispose of mixed waste, chemical and elemental species survey capabilities have significant cost and logistical advantages for a remediation program.

By way of non-limiting examples, the system 100 may be configured to detect unacceptable levels of elemental species such as beryllium oxides, hydroxides, and heavy metals, as defined by the Resource Conservation and Recovery Act (RCRA) list (e.g., arsenic, barium, cadmium, chromium, lead, mercury, selenium, and silver). By way of other non-limiting examples, the system 100 may be configured to detect unacceptable levels of materials (e.g., target metals) of concern present in various industries, such as aluminum, antimony, calcium, cobalt, iron, magnesium, manganese, nickel, potassium, sodium, thallium, vanadium, and zinc. By way of non-limiting examples, elemental species and/or other materials may be detected by the system 100 using terahertz spectrographic interrogation (THz), energy dispersive x-ray fluorescence ("XRF"), and/or laser-induced breakdown spectroscopy ("LIBS").

In some embodiments, the system 100 may be equipped with "sniffer" technologies configured to identify volatile organic compound ("VOC") contamination in soil. VOCs are identified as gases emitted from certain solids or liquids that are present in the soil. VOCs include a variety of chemicals, such as motor fuels, aviation fuels, oil, paints, metal vapors, industrial solvents, cleaning chemicals, pesticides, and various acid and base solutions. Many VOCs may have short-term and/or long-term adverse health effects.

In some embodiments, the system 100 may include one or more metal-detecting technologies (such as monoloop detectors) configured to identify mineralized soils, nuggets, and fines. Thus, the system 100 may be used in mining operations.

These same metal-detecting technologies can be used to locate and segregate unwanted metals from the pre-evaluation soil stream 152. For example, in such embodiments, the system 100 may be used to locate and segregate shell fragments, grenade fragments, and various munitions from soil. The system 100 may also include suspended magnets and/or magnetic conveyors to be used for this purpose.

Optionally, the system 100 may include neutron emitting detection systems configured to identify plastic anti-personnel mines and hydrocarbon-based explosive materials in the pre-evaluation soil stream 152.

Diversion System

Referring to FIG. 2A, the diversion system 180 physically separates contaminated soil and clean soil. The evaluated soil stream 162 is transported by the soil transport mechanism 140 to the diversion system 180. In the embodiment illustrated, the evaluated soil stream 162 simply travels off the downstream most end of the main conveyor 360 and is deposited on the diversion system 180.

Referring to FIG. 2B, for ease of illustration, the diversion system 180 will be described as being a reversible diversion conveyor 600. However, through application of ordinary skill in the art to the present teachings alternate structures may be used to physically separate contaminated soil and clean soil. For example, the diversion system 180 may include electrically operated diversion chutes (not shown) located at or near the downstream-most end of the main conveyor 360.

The control system 170 (see FIG. 1) instructs the diversion system 180 in which direction to transport the portion of the evaluated soil stream 162 deposited thereupon. For example, the reversible diversion conveyor 600 can travel toward the "hot" side 106, or to the "clean" side 108 of the system 100. Thus, the control system 170 (see FIG. 1) can send a portion of the evaluated soil stream 162 to the "hot" side 106, or to the "clean" side 108 of the system 100. The reversible diversion conveyor 600 has a first (hot) discharge end portion 606 on the "hot" side 106 of the system 100, and a second (clean) discharge end portion 608 on the "clean" side 108 of the system 100

Processed soil exiting each of the first and second discharge end portions 606 and 608 of the reversible diversion conveyor 600 may be diverted and discharged onto a stacking conveyor (not shown) that creates a soil stockpile for final disposition. Thus, a first stockpile (not shown) may be created on the "hot" side 106, and a second stockpile (not shown) may be created on the "clean" side 108. Alternatively, other methods of handling soil discharged from the first and second discharge end portions 606 and 608 of the reversible diversion conveyor 600 may be used, such as bins, trucks, railcars, other soil transport methods, and sub-combinations or combinations thereof.

Referring to FIG. 2B, the reversible diversion conveyor 600 may be transverse to the main conveyor 360. By way of a non-limiting example, the reversible diversion conveyor 600 may travel at a speed of about 140 feet per minute, and may stop and reverse direction within three seconds. The reversible diversion conveyor 600 has a belt 610 that may be implemented using a BeltFab RM2-220 3×1 ply 30 inches wide rubber conveyor belt. This belt 610 may be field-vulcanized to provide seamless construction. The belt 610 may be driven by a PPI 8.0×32.0 drive pulley, with PPI XT35 3 7/16 inches bushings and one-half inch of applied SBR 60 rubber lagging. This pulley uses a solid 3 7/16 inches shaft supported by 2-bolt PBE 3 7/16 inches bore pillow blocks.

The head pulley blocks are directly mounted to the frame 200 (see FIG. 2A) of the system 100. The tail pulley is identical to the head pulley and is also lagged because of the need for stopping traction when reversing the belt 610. The tail pulley blocks are mounted to the frame 200 by conventional take-up frames, Bryant Telescoper PST-400×18. The reversible diversion conveyor 600 may use troughing idlers, PPI B4-20TE-30SB, and rubber disc return idlers, PPI B4-RRD-30SB.

As mentioned above, during use, the reversible diversion conveyor 600 may be transverse to the main conveyor 360. In some embodiments, the reversible diversion conveyor 600 is rotatable relative to the frame 200. In the embodiment illustrated, the reversible diversion conveyor 600 rotates horizontally about ninety degrees. The reversible diversion conveyor 600 may be rotated in the direction of curved arrows "B1" and "B2" to a position substantially parallel with the main conveyor 360 for storage and transport. From that storage position, the reversible diversion conveyor 600 may be rotated in a direction opposite that shown by the curved arrows "B1" and "B2" to a position substantially orthogonal with the main conveyor 360 for use. In rotatable implementations of the reversible diversion conveyor 600, the reversible diversion conveyor 600 includes wheels and a turntable bearing at its pivot point (or center of rotation). The bearing may be an SKF UT10CN non-locking turntable bearing.

The reversible diversion conveyor 600 is driven by at least one drive motor 612. The drive motor 612 may be implemented by a serially controlled Nord SK32-100L/4 CUS-T1 0/1 S SK300E-221-340-B gearmotor with a motor-mounted "Trio" inverter. This drive may include an optional SK CU2-STD P/N 75130020 interface and a SK300E IC1-300E communications cable. The drive motor 612 is configured to receive the instructions 166 (see FIG. 1) from the control system 170. The instructions 166 instruct the drive motor 612 in which direction to drive the belt 610 of the reversible diversion conveyor 600. In response to receiving the instructions 166, the drive motor 612 drives the belt 610 in the direction indicated by the instructions 166.

Referring to FIG. 2B, the reversible diversion conveyor 600 may be equipped with primary conveyor belt cleaning systems (not shown). Such systems may include tensioned scraper systems that provide a scraper configured to scrape material from the belt 610. The scraper may be constructed with a knife-edge of polymeric material or metal. The scraper may be positioned on or against the surface of the belt 610 at or near the head pulley or underneath the belt. The scraper scrapes mud (called carryback), ice, or snow build-up from the belt 610. Secondary scrapers positioned under the belt 610 may also be used to help minimize carryback.

Control System

Referring to FIG. 1, as mentioned above, the control system 170 may be at least partially housed inside the control room 172 mounted on the frame 200 (see FIG. 2A). The control room 172 also provides space for electrical cabinets and shelter for the operators 104, if needed. Referring to FIG. 2A, the control room 172 may include windows 700 that allow the operators 104 to keep an eye on the heavy equipment operations that support the system 100. The control room 172 may be temperature controlled. In the embodiment illustrated in FIG. 2B, the control room 172 has lockable doors 706 and 708 on the "hot" and "clean" sides 106 and 108, respectively, of the system 100.

The system 100 may include at least one emergency stop ("e-stop"). In the embodiment illustrated, an e-stop (not shown) may be mounted on the front of the control room 172. By way of a non-limiting example, the system 100 may include four e-stops.

Lights (e.g., LED spotlights) may be mounted on the outside of the control room 172 to flood the first and second discharge end portions 606 and 608 of the reversible diversion conveyor 600 during nighttime operations. The control room 172 may include one or more 120 volt outlets for running air samplers and additional lighting, if needed.

Referring to FIG. 2A, the frame 200 may be outfitted with access ladders (not shown) and safety gates (not shown) at the access ladders. The area inside the safety gates may accommodate a Radiological Buffer Area control line, where the operators 104 (see FIG. 1) may undergo processing or evaluation before being allowed to enter the control room 172 or being allowed to exit the system 100.

Figure 5:
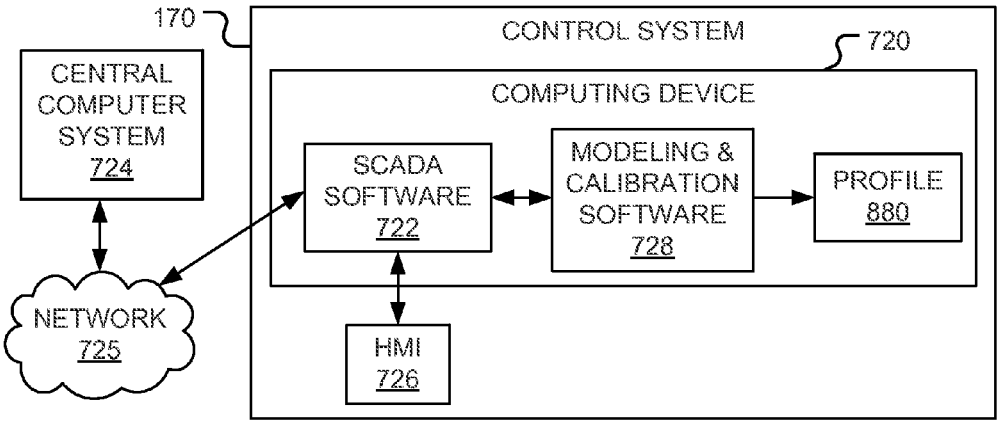
FIG. 5 is a block diagram of a control system subcomponent of the system.

All of the data collection systems of the system 100 may be connected (via wired or wireless connections) to the control system 170. Referring to FIG. 5, the control system 170 includes at least one computing device (e.g., a computing device 720) executing a supervisory control and data acquisition ("SCADA") software program 722 configured to control the soil sorting process. For example, the SCADA software program 722 may instruct the drive motor 612 (see FIG. 2B) of the reversible diversion conveyor 600 in which direction to travel. The SCADA software program 722 may be implemented using a program named DAQFactory, which is available from Azeotech, Inc. DAQFactory provides a stable, Windows-based interface platform, on which SCADA functionality may be programmed.

The SCADA software program 722 may gather and monitor digital information, and log that information on a central computer system 724 connected to the control system 170 (e.g., via a network 725 such as the Internet). The SCADA software program 722 may perform these functions in real time. The SCADA software program 722 may have one or more programming parameters with values that may be selected or determined by the operators 104 (see FIG. 1). The SCADA software program 722 may conduct analysis and exercise control based on the values of those programming parameters.

The SCADA software program 722 may be configured to display information in a logical and organized fashion via a human/machine interface ("HMI") 726 (e.g., a monitor or other type of display device). The HMI 726 may be configured to display trend graphs, waterfall graphs, tabular data, and the like.

The computing device 720 executes the one or more modeling and calibration software programs 728 that model detector array geometry, determine energy and efficiency calibration values for the detector system 160, and provide data to the SCADA software program 722 that the SCADA software program 722 uses to control components of the system 100 (e.g., the diversion system 180). For example, the SCADA software program 722 may instruct the reversible diversion conveyor 600 to travel toward the "hot" side 106 (see FIG. 2B) when the modeling and calibration software programs 728 indicate that an amount of radiation detected by the detector system 160 exceeds a predetermined amount. Similarly, the SCADA software program 722 may instruct the reversible diversion conveyor 600 to travel toward the "clean" side 108 (see FIG. 2B) when the modeling and calibration software programs 728 indicate that the amount of radiation detected by the detector system 160 is less than the predetermined amount. Further, the SCADA software program 722 may delay an instruction to travel in a particular direction until the portion of the feed soil 102 evaluated reaches the reversible diversion conveyor 600.

By way of a non-limiting example, the modeling and calibration software programs 728 may include a Genie 2000 Gamma Acquisition and Analysis software package, available from Canberra Industries Inc. This software package includes In-Situ Object Counting System ("ISOCS") software, and Genie-2000 Geometry Composer software.

Each of the computing devices (e.g., the computing device 720 and the central computer system 724) depicted in FIG. 5 may be implemented by a computing device 12 descripted below and illustrated in FIG. 8.

Methods

Figure 6:
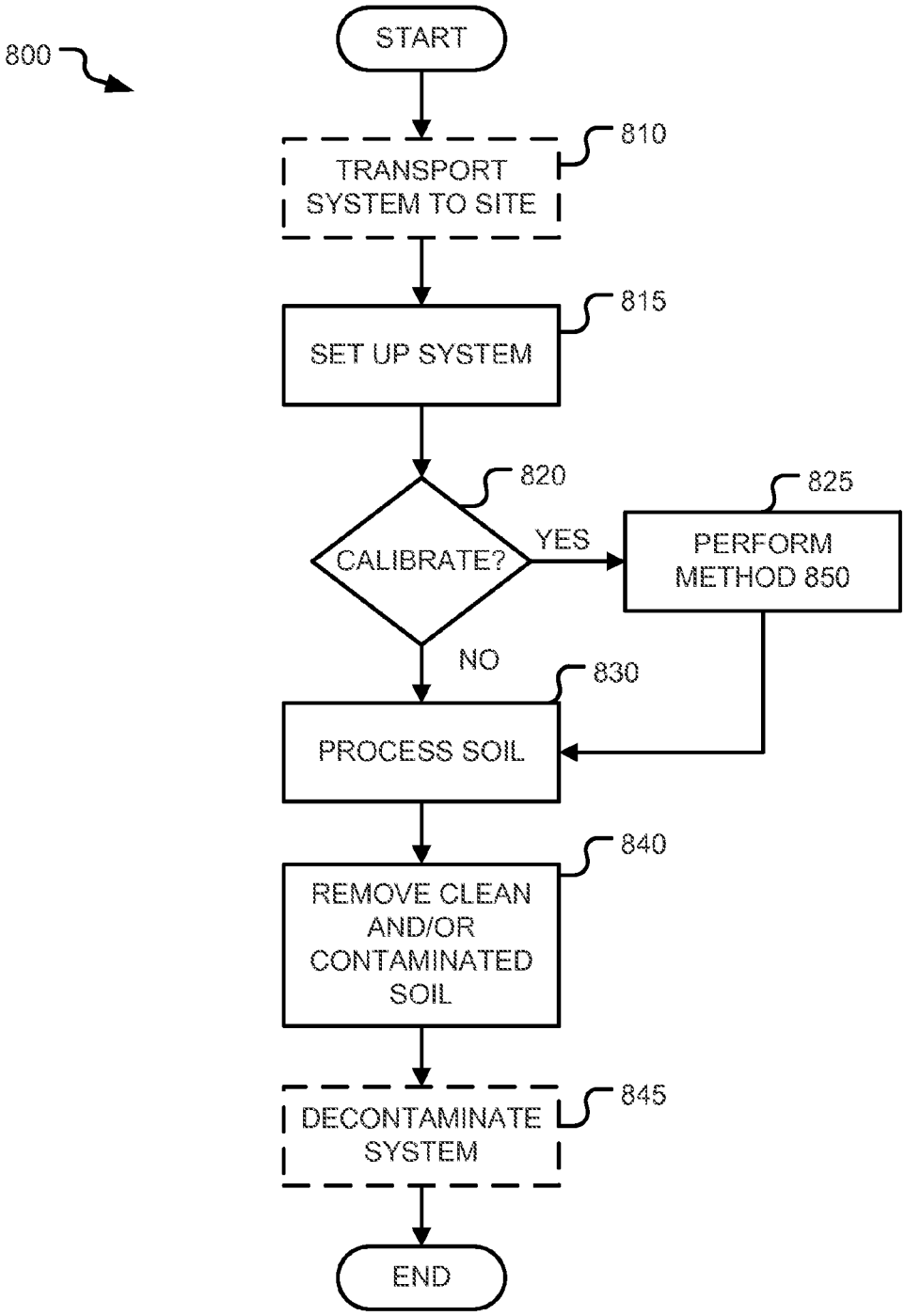
FIG. 6 is a flow diagram depicting a method of operating the system.

FIG. 6 is a flow diagram of a method 800 performed with respect to the system 100. In optional first block 810, the system 100 is transported to a jobsite. Then, in block 815, the system 100 is set up for use. For example, the detection system 160 may be connected to the control system 170. The control system 170 may be connected to the diversion system 180. Further, powered components of the system 100 may be connected to the power source 190. The feed soil transport 120 may be positioned to supply the feed soil 102 to the soil transport mechanism 140. The diversion system 180 may be configured to transport soil to the "hot" side 106 and the "clean" side 108 of the system 100. Further, other types of adjustments may be made. For example, the height of the surge bin 130, the first screed 342, and/or the second screed 150 may be adjusted. Catwalk and stair components (not shown) may be assembled.

Figure 7A:
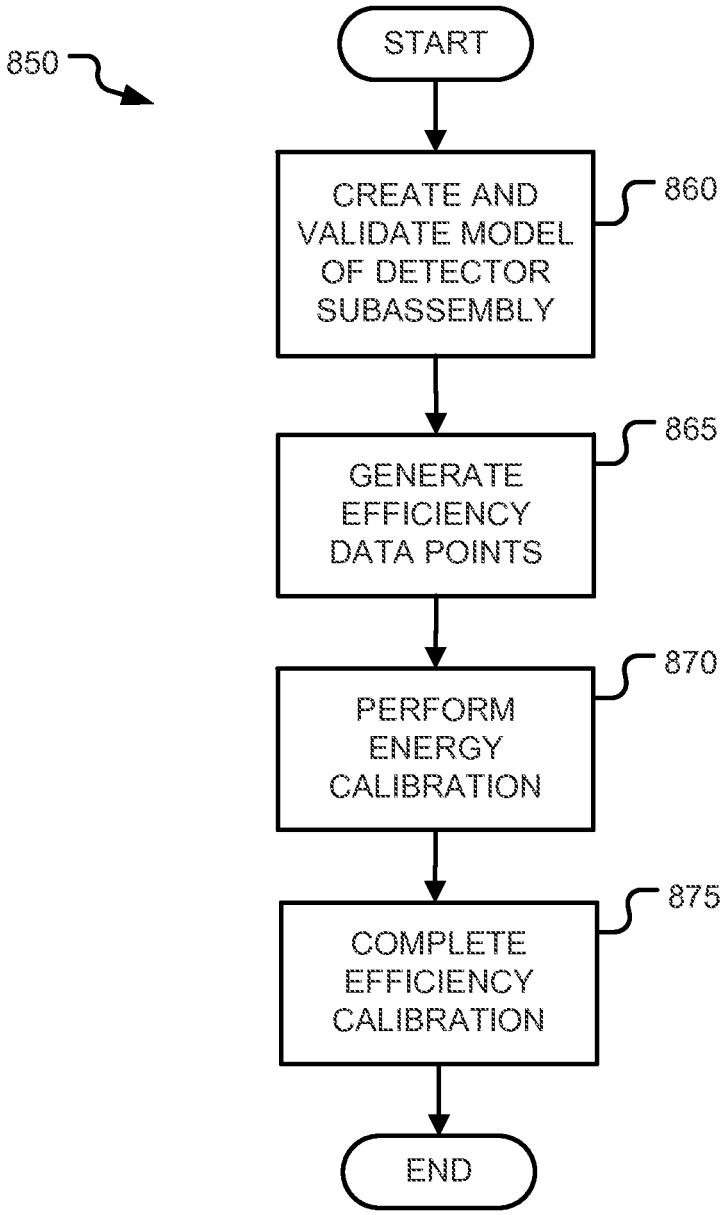
FIG. 7A is a flow diagram of a method of calibrating the detector system and/or the control system.

In decision block 820, the operators 104 (see FIG. 1) decide whether to calibrate the control system 170. When the decision in decision block 820 is "YES," in block 825, a method 850 illustrated in FIG. 7A is performed.

On the other hand, when the decision in decision block 820 is "NO," in block 830, the system 100 processes the feed soil 102 (see FIGS. 1-3D). One hundred percent of the feed soil 102 may be transported by the soil transport mechanism 140 and conservatively surveyed by the detection system 160 at a rate of about six feet per second. Because the system 100 may evaluate 100% of the feed soil 102, and the field of view of the detector array 410 covers the entire volume of the feed soil, the system 100 may provide a high level of confidence that all areas of elevated activity will be identified.

In block 840, soil accumulated on the "hot" side 106 may be transported to a suitable storage location for such soil and/or soil accumulated on the "clean" side 108 may be returned to its original location or transported to another location.

In optional block 845, the operators 104 may decontaminate the system 100. Depending upon the implementation details, every part of the system 100 may be decontaminated with a power sprayer. Optionally, the system 100 may be reconfigured (e.g., partially disassembled) for transport to another location.

Then, the method 800 terminates.

FIG. 7A is a flow diagram of the method 850 performed by the control system 170 executing the modeling and calibration software programs 728. As explained above, the information 166 (see FIG. 1) received by the control system 170 from the detection system 160 includes the signals 532 transmitted by the detector subassemblies 431-441. In the example illustrated, the detector array 410 includes eleven detector subassemblies. Thus, the control system 170 receives eleven separate signals 532 from the detector array 410. While each signal may include a pulse count value for different channels, for the ease of illustration, only a single series of pulses for one channel will be described. Thus, in this example, each signal includes a series of pulse count values indicating the amount of radiation detected by the radiation detector 442. The control system 170 uses these pulse count values to determine whether the portion of soil under the detector system 160 is clean or contaminated. The portion of soil is determined to be clean when it satisfies predefined release criteria. On the other hand, the portion of soil is determined to be contaminated when it fails to satisfy the predefined release criteria. For example, pulse count values generated for the same time period may be aggregated (e.g., summed, averaged, and the like) and that aggregate value compared to a threshold value. If the aggregate value exceeds the threshold value, the soil may be determined to be contaminated. On the other hand, if the aggregate value does not exceed the threshold value, the soil may be determined to be clean. Thus, proper calibration of the detector system 160 and/or the control system 170 is important.

Figure 7B:
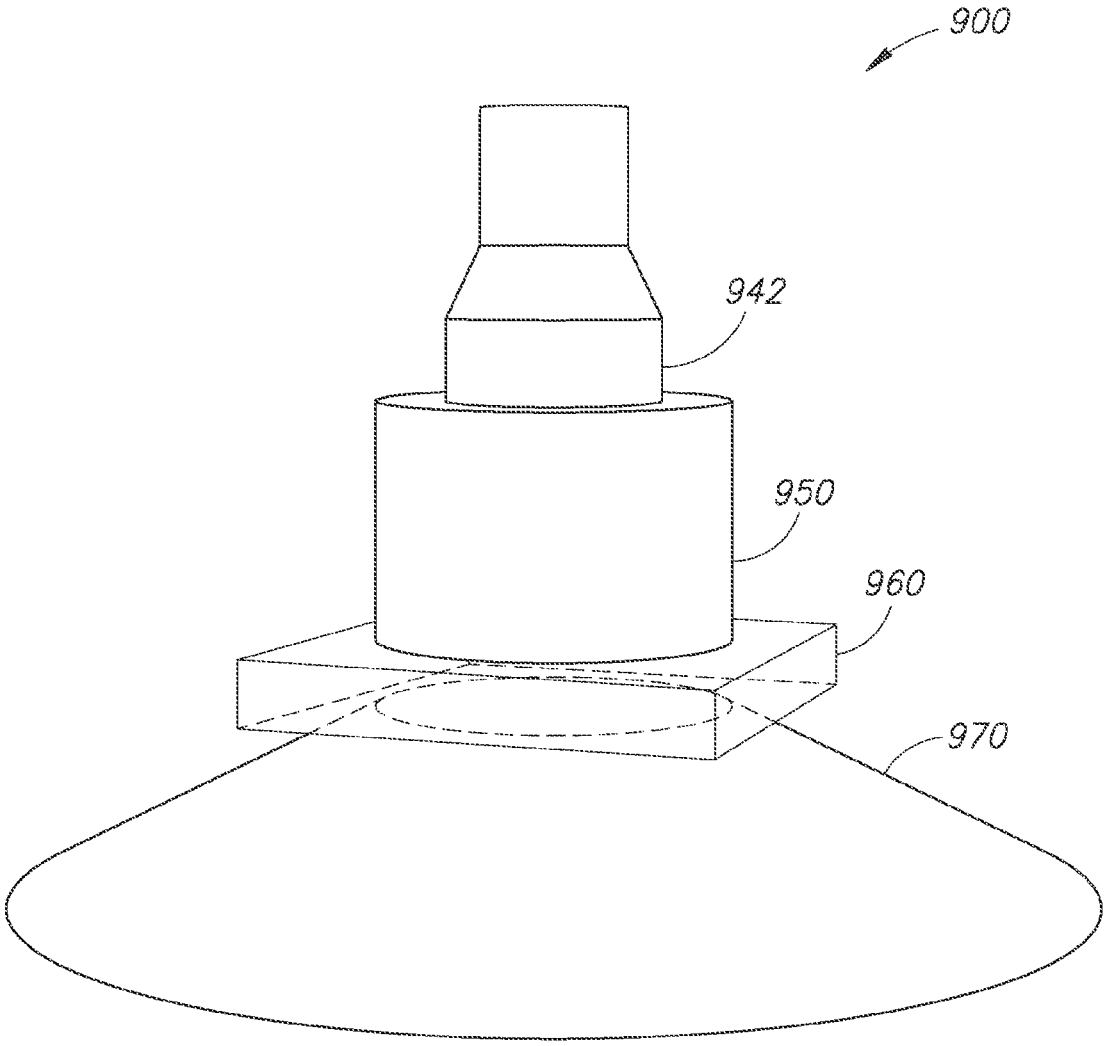
FIG. 7B is a computer generated rendering of a model of one of the detector subassemblies and its field of view.

In first block 860, the operators 104 operate the modeling and calibration software programs 728 (e.g., using the ISOCS software and Genie-2000 Geometry Composer software) and use it to create and validate a model 900 (see FIG. 7B) of one of the detector subassemblies 431-441, which includes a model 942 of the radiation detector 442, a model 950 of the collimator well 450 surrounding the radiation detector 442, and an air absorber model 960. FIG. 7B illustrates the field-of-view of the model 942 of the radiation detector 442. As illustrated in FIG. 7B, the field-of-view of the model 942 of the radiation detector 442 includes a soil frustum 970. The modeling and calibration software programs 728 (e.g., the Genie-2000 Geometry Composer software) verifies and validates the models 942, 950, and 960 as well as the source geometry used to create them.

Referring to FIG. 7A, in next block 865, the operators 104 operate the modeling and calibration software programs 728 and the model 900 (see FIG. 7B) to generate reference efficiency data points that may be compared to actual physical efficiency determinations that may evolve later in block 875.

In block 870, the operators 104 perform an energy calibration using the modeling and calibration software programs 728 (e.g., the Genie 2000 Gamma Acquisition and Analysis software package). The detector array 410 (see FIG. 4A) captures data from a selected radiation source (e.g., a uranium ore sample) having unknown emission values. The resulting data may be displayed as a spectrum, and a cursor may be positioned on one of the peak values. Then, the peak value may be adjusted by the modeling and calibration software programs 728 to correspond with a library 872 (see FIG. 5) of known energies for that nuclide. Interpolation and/or other curve fitting techniques may be used to determine values between peaks.

The modeling and calibration software programs 728 (e.g., the Genie 2000 Gamma Acquisition and Analysis software package) may include or access a characterization profile 880 (see FIG. 5) for the radiation detector 442 (e.g., a Canberra ISOCS/LabSOCS Characterization Profile for 3×3 NaI detectors). The characterization profile 880 may be used to identify and account for the properties inherent in the spectroscopy of the radiation detector 442 when compared with other types of detectors (e.g., germanium detectors).

In last block 875, the operators 104 may complete the efficiency calibration by performing dynamic, meaning moving, hot particle, and distributed contamination efficiencies using National Institute of Standards and Technology ("NIST") traceable bulk or point sources and blank plastic tiles that have a uniform density near to actual soil densities. These tiles and sources may be placed on the soil transport mechanism 140 (e.g., on the main conveyor belt 362) and transported thereby past the detector subassemblies 431-441, which obtain pulse count values and transmit them to the control system 170 as efficiency data points. The efficiency data points received by the control system 170 are compiled and may be used as a basis for an efficiency calibration. For example, the control system 170 may compare the reference efficiency data points obtained in block 865 with the dynamic efficiency data points obtained in block 875. If the two agree, the efficiencies were performed in a desirable (e.g., optimal) detector-source configuration.

Then, the method 850 terminates.

At this point, the control system 170 is ready to process the feed soil 102. For example, in block 865, the method 850 may have determined the efficiency data point for radium-226 in the field of view (i.e., the soil frustum 970) was about 0.04. This value can be used as dynamic efficiency value (or the value of variable "E") in the following bulk/diffuse activity calculation (defined in the ORAU 5849-8):

$$pCi/g = \frac{(c - B)}{t * E * 2.22 * M}$$

where:

t=time period (minutes) over which the count was recorded c=gross count

B=count during recording period, due only to background levels of radiation

E=detection efficiency of instrument in counts per disintegration

M=mass of sample analyzed in grams 2.22=factor to convert a disintegration rate to activity units of picocuries, i.e. dpm/pCi The above equation calculates the radionuclide concentration (in picocuries per gram) in the soil. A soil density of one gram per cubic centimeter ("cc") may be used.

The bulk/diffuse activity calculation may be modified by including the standard deviation ("SD") value of the net count rate:

$$pCi/g = \frac{((c - B) + SD)}{t * E * 2.22 * M}$$

Counting instruments typically have a confidence interval of about 95%, which corresponds to ±1.966 sigma. This means that for a particular activity result, there is a 95% confidence that the actual activity lies between ±1.96 sigma of the result. The equation below takes into account the confidence interval of 95%, and can be used to determine the standard deviation of the net cpm. In other words, the standard deviation for a single measurement at 95% confidence level may be calculated as follows:

$$95\%\ SD = 1.966 * Sqrt((rg/tg) + (rb/tb))$$

where:

k=Poisson probability sum for a and b (assuming a and b are equal), associated with the confidence level (for 95% confidence, 1.645)

95% SD=standard deviation, at 95% confidence, of the netcpm rg=gross counting rate tg=1 second, the time during which the gross count was made rb=background counting rate rt=1 second, the time during which the background count was made (ten minute bkg count reduced to cps)

A geometrically correct source board may be placed beneath the detector array 410 to perform Quality Assurance/Quality Control source counts. For dynamic assay comparisons, sources may be placed anywhere in stacks to simulate actual particle distribution or bulk contamination horizons in soil. These constructs are then passed under the detector array 410 at a selected belt speed.

Computing Device

Figure 8:
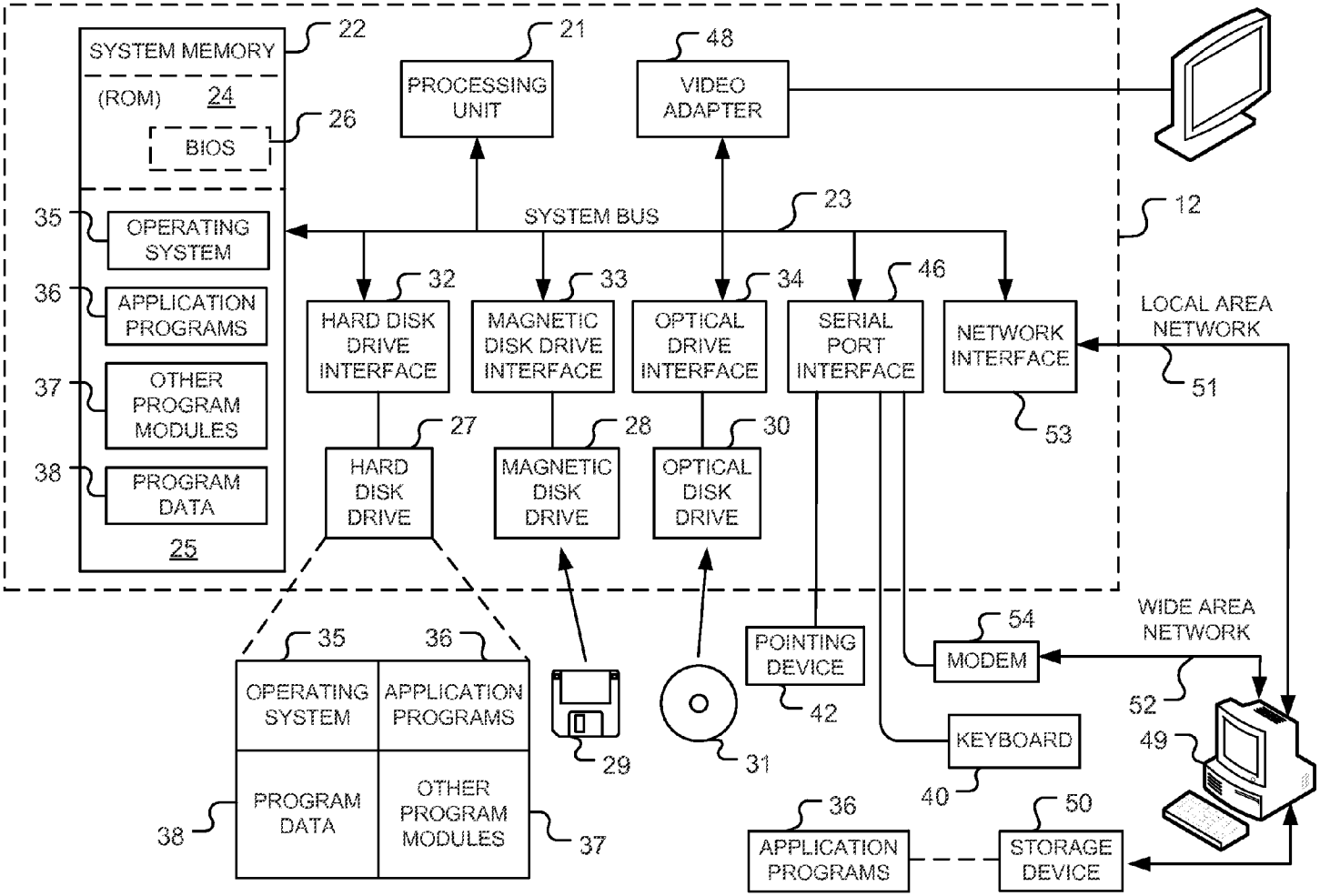
FIG. 8 is a diagram of a hardware environment and an operating environment in which the computing devices of FIG. 5 may be implemented.

FIG. 8 is a diagram of hardware and an operating environment in conjunction with which implementations of the one or more computing devices of the system 100 may be practiced. The description of FIG. 8 is intended to provide a brief, general description of suitable computer hardware and a suitable computing environment in which implementations may be practiced. Although not required, implementations are described in the general context of computer-executable instructions, such as program modules, being executed by a computer, such as a personal computer. Generally, program modules include routines, programs, objects, components, data structures, etc., that perform particular tasks or implement particular abstract data types.

Moreover, those skilled in the art will appreciate that implementations may be practiced with other computer system configurations, including hand-held devices, multiprocessor systems, microprocessor-based or programmable consumer electronics, network PCs, minicomputers, mainframe computers, and the like. Implementations may also be practiced in distributed computing environments where tasks are performed by remote processing devices that are linked through a communications network. In a distributed computing environment, program modules may be located in both local and remote memory storage devices.

The exemplary hardware and operating environment of FIG. 8 includes a general-purpose computing device in the form of the computing device 12. Each of the computing devices of FIG. 5 (including the computing device 720 and the central computer system 724) may be substantially identical to the computing device 12. By way of non-limiting examples, the computing device 12 may be implemented as a laptop computer, a tablet computer, a web enabled television, a personal digital assistant, a game console, a smartphone, a mobile computing device, a cellular telephone, a desktop personal computer, and the like.

The computing device 12 includes a system memory 22, the processing unit 21, and a system bus 23 that operatively couples various system components, including the system memory 22, to the processing unit 21. There may be only one or there may be more than one processing unit 21, such that the processor of computing device 12 includes a single central-processing unit ("CPU"), or a plurality of processing units, commonly referred to as a parallel processing environment. When multiple processing units are used, the processing units may be heterogeneous. By way of a non-limiting example, such a heterogeneous processing environment may include a conventional CPU, a conventional graphics processing unit ("GPU"), a floating-point unit ("FPU"), combinations thereof, and the like.

The computing device 12 may be a conventional computer, a distributed computer, or any other type of computer.

The system bus 23 may be any of several types of bus structures including a memory bus or memory controller, a peripheral bus, and a local bus using any of a variety of bus architectures. The system memory 22 may also be referred to as simply the memory, and includes read only memory (ROM) 24 and random access memory (RAM) 25. A basic input/output system (BIOS) 26, containing the basic routines that help to transfer information between elements within the computing device 12, such as during start-up, is stored in ROM 24. The computing device 12 further includes a hard disk drive 27 for reading from and writing to a hard disk, not shown, a magnetic disk drive 28 for reading from or writing to a removable magnetic disk 29, and an optical disk drive 30 for reading from or writing to a removable optical disk 31 such as a CD ROM, DVD, or other optical media.

The hard disk drive 27, magnetic disk drive 28, and optical disk drive 30 are connected to the system bus 23 by a hard disk drive interface 32, a magnetic disk drive interface 33, and an optical disk drive interface 34, respectively. The drives and their associated computer-readable media provide nonvolatile storage of computer-readable instructions, data structures, program modules, and other data for the computing device 12. It should be appreciated by those skilled in the art that any type of computer-readable media which can store data that is accessible by a computer, such as magnetic cassettes, flash memory cards, solid state memory devices ("SSD"), USB drives, digital video disks, Bernoulli cartridges, random access memories (RAMs), read only memories (ROMs), and the like, may be used in the exemplary operating environment. As is apparent to those of ordinary skill in the art, the hard disk drive 27 and other forms of computer-readable media (e.g., the removable magnetic disk 29, the removable optical disk 31, flash memory cards, SSD, USB drives, and the like) accessible by the processing unit 21 may be considered components of the system memory 22.

A number of program modules may be stored on the hard disk drive 27, magnetic disk 29, optical disk 31, ROM 24, or RAM 25, including the operating system 35, one or more application programs 36, other program modules 37, and program data 38. A user may enter commands and information into the computing device 12 through input devices such as a keyboard 40 and pointing device 42. Other input devices (not shown) may include a microphone, joystick, game pad, satellite dish, scanner, touch sensitive devices (e.g., a stylus or touch pad), video camera, depth camera, or the like. These and other input devices are often connected to the processing unit 21 through a serial port interface 46 that is coupled to the system bus 23, but may be connected by other interfaces, such as a parallel port, game port, a universal serial bus (USB), or a wireless interface (e.g., a Bluetooth interface). A monitor 47 or other type of display device is also connected to the system bus 23 via an interface, such as a video adapter 48. In addition to the monitor, computers typically include other peripheral output devices (not shown), such as speakers, printers, and haptic devices that provide tactile and/or other types of physical feedback (e.g., a force feedback game controller).

The input devices described above are operable to receive user input and selections. Together the input and display devices may be described as providing a user interface. Further, the HMI 726 may include any of the components of the user interface, as well as the monitor 47 or other type of display device.

The computing device 12 may operate in a networked environment using logical connections to one or more remote computers, such as remote computer 49. These logical connections are achieved by a communication device coupled to or a part of the computing device 12 (as the local computer). Implementations are not limited to a particular type of communications device. The remote computer 49 may be another computer, a server, a router, a network PC, a client, a memory storage device, a peer device or other common network node, and typically includes many or all of the elements described above relative to the computing device 12. The remote computer 49 may be connected to a memory storage device 50. The logical connections depicted in FIG. 8 include a local-area network (LAN) 51 and a wide-area network (WAN) 52. Such networking environments are commonplace in offices, enterprise-wide computer networks, intranets and the Internet. The network 725 (see FIG. 5) may be implemented using one or more of the LAN 51 or the WAN 52 (e.g., the Internet).

Those of ordinary skill in the art will appreciate that a LAN may be connected to a WAN via a modem using a carrier signal over a telephone network, cable network, cellular network, or power lines. Such a modem may be connected to the computing device 12 by a network interface (e.g., a serial or other type of port). Further, many laptop computers may connect to a network via a cellular data modem.

When used in a LAN-networking environment, the computing device 12 is connected to the local area network 51 through a network interface or adapter 53, which is one type of communications device. When used in a WAN-networking environment, the computing device 12 typically includes a modem 54, a type of communications device, or any other type of communications device for establishing communications over the wide area network 52, such as the Internet. The modem 54, which may be internal or external, is connected to the system bus 23 via the serial port interface 46. In a networked environment, program modules depicted relative to the personal computing device 12, or portions thereof, may be stored in the remote computer 49 and/or the remote memory storage device 50. It is appreciated that the network connections shown are exemplary and other means of and communications devices for establishing a communications link between the computers may be used.

The computing device 12 and related components have been presented herein by way of particular example and also by abstraction in order to facilitate a high-level view of the concepts disclosed. The actual technical design and implementation may vary based on particular implementation while maintaining the overall nature of the concepts disclosed.

In some embodiments, the system memory 22 stores computer executable instructions that when executed by one or more processors cause the one or more processors to perform all or portions of one or more of the methods (including the methods 800 and 850 illustrated in FIGS. 6 and 7A, respectively) described above. Such instructions may be stored on one or more non-transitory computer-readable media.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A system for use with a feed material, the system comprising:

a detector system;

a control system connected to the detector system;

a diversion system connected to the control system;

a main conveyor configured to transport the feed material past the detector system and to the diversion system, the detector system being operable to detect a level of a contaminant in the feed material transported past the detector system by the main conveyor and transmit a signal to the control system indicating the level, the control system being operable to instruct the diversion system to deposit the feed material in a first area when the level exceeds predefined release criteria, the control system being further operable to instruct the diversion system to deposit the feed material in a second area when the level does not exceed predefined release criteria; and a surge bin comprising a screed, the surge bin being mounted above the main conveyor and configured to receive the feed material and deposit the feed material on the main conveyor as an initial material stream.

2. The system of claim 1, wherein the detector system comprises a plurality of detector assemblies, each comprising a radiation detector.

3. The system of claim 2, wherein the radiation detector is a sodium iodide (NaI) radiation detector.

4. The system of claim 2, wherein the radiation detector is at least partially surrounded by a cylindrically shaped collimator well constructed from a material denser than lead.

5. The system of claim 1, wherein the screed is a first screed, the initial material stream has a thickness, the main conveyor travels in a downstream direction, and the system further comprises a second screed positioned above the main conveyor at a downstream location from the surge bin, the second screed being configured to reduce the thickness of the initial material stream.

6. The system of claim 5, wherein the first screed is attached to the surge bin and configured to shape the feed material to produce the initial material stream.

7. The system of claim 1, further comprising:

bin level indicators attached to the surge bin and configured to detect a level of feed material in the surge bin.

8. The system of claim 1, wherein the diversion system is a reversible conveyor having a first end portion positioned adjacent the first area, and a second end portion positioned adjacent the second area, the control system is operable to instruct the reversible conveyor to travel in a first direction toward the first area to deposit the feed material in the first area, and the control system is operable to instruct the reversible conveyor to travel in a second direction toward the second area to deposit the feed material in a second area.

9. The system of claim 8, wherein the reversible conveyor is selectively rotatable about a center of rotation into and out of a storage position.

10. The system of claim 1, further comprising:

a transportable trailer, the detector system, the control system, the diversion system, and the main conveyor being mounted on the trailer and operable thereupon.

11. The system of claim 1, wherein the detection system is a first detection system, and the system further comprises:

a second detection system configured to detect a level of an elemental species, a selected contaminant, or a volatile organic compound.

12. The system of claim 1, further comprising a metal-detector configured to detect metal in the feed material.

13. The system of claim 1, wherein the feed material comprises at least one of soil, concrete rubble, masonry rubble, ore, ash, metallic shapes, metallic scraps, and vegetable matter.

14. The system of claim 1, wherein the surge bin is pivotably mounted above the main conveyor;

the initial material stream has a thickness; and the system further comprises at least one height adjustment mechanism configured to rotate the surge bin relative to the main conveyor to adjust the thickness of the initial material stream.

15. The system of claim 1, wherein the surge bin has an upper opening configured to receive the feed material and a lower opening configured to deposit the feed material on the main conveyor, and the surge bin is tapered outwardly from the upper opening and tapered inwardly toward the lower opening.

16. The system of claim 15, wherein the lower opening deposits the feed material on the main conveyor as the initial material stream, and the screed is configured to shape the initial material stream as the initial material stream exits the surge bin.

17. A system for use with a feed material, the system comprising:

a detector system;

a control system connected to the detector system;

a reversible conveyor connected to the control system, the reversible conveyor having a first end portion positioned adjacent a first area, and a second end portion positioned adjacent a second area; and a material transport mechanism configured to transport the feed material past the detector system and to the reversible conveyor, the detector system being operable to detect a level of a contaminant in the feed material transported past the detector system by the material transport mechanism and transmit a signal to the control system indicating the level, the control system being operable to instruct the reversible conveyor to travel in a first direction toward the first area and deposit the feed material in the first area when the level exceeds predefined release criteria, the control system being further operable to instruct the reversible conveyor to travel in a second direction toward the second area and deposit the feed material in the second area when the level does not exceed predefined release criteria.

18. The system of claim 17, wherein the detector system comprises a plurality of detector assemblies, each comprising a radiation detector.

19. The system of claim 18, wherein the radiation detector is a sodium iodide (NaI) radiation detector.

20. The system of claim 18, wherein the radiation detector is at least partially surrounded by a cylindrically shaped collimator well constructed from a material denser than lead.

21. The system of claim 17, wherein the material transport mechanism is a main conveyor traveling in a downstream direction, and the system further comprises:

a surge bin mounted above the main conveyor, the surge bin being configured to receive the feed material and deposit the feed material on the main conveyor as an initial material stream; and a screed positioned above the main conveyor at a downstream location from the surge bin, the screed being configured to reduce a thickness of the initial material stream.

22. The system of claim 21, wherein the screed is a second screed, and the system further comprises a first screed attached to the surge bin and configured to shape the feed material to produce the initial material stream.

23. The system of claim 21, further comprising:

bin level indicators attached to the surge bin and configured to detect a level of feed material in the surge bin.

24. The system of claim 17, wherein the reversible conveyor is selectively rotatable about a center of rotation into and out of a storage position.

25. The system of claim 17, further comprising:

a transportable trailer, the detector system, the control system, the reversible conveyor, and the material transport mechanism being mounted on the trailer and operable thereupon.

26. The system of claim 17, wherein the detection system is a first detection system, and the system further comprises:

a second detection system configured to detect a level of an elemental species, a selected contaminant, or a volatile organic compound.

27. The system of claim 17, further comprising a metal-detector configured to detect metal in the feed material.

28. The system of claim 17, wherein the feed material comprises at least one of soil, concrete rubble, masonry rubble, ore, ash, metallic shapes, metallic scraps, and vegetable matter.

29. The system of claim 17, wherein the material transport mechanism is a main conveyor and the system further comprises:

a surge bin pivotably mounted above the main conveyor and configured to receive the feed material and deposit the feed material on the main conveyor as an initial material stream having a thickness; and at least one height adjustment mechanism configured to rotate the surge bin relative to the main conveyor to adjust the thickness of the initial material stream.

30. The system of claim 17, wherein the material transport mechanism is a main conveyor and the system further comprises:

a surge bin mounted above the main conveyor, the surge bin having an upper opening configured to receive the feed material and a lower opening configured to deposit the feed material on the main conveyor, the surge bin being tapered outwardly from the upper opening and tapered inwardly toward the lower opening.

31. The system of claim 30, wherein the lower opening deposits the feed material on the main conveyor as an initial material stream, and the surge bin comprises a screed configured to shape the initial material stream as the initial material stream exits the surge bin.

32. A system for use with a feed material, the system comprising:

a detector system;

a control system connected to the detector system;

a diversion system connected to the control system;

a material transport mechanism configured to transport the feed material past the detector system and to the diversion system, the detector system being operable to detect a level of a contaminant in the feed material transported past the detector system by the material transport mechanism and transmit a signal to the control system indicating the level, the control system being operable to instruct the diversion system to deposit the feed material in a first area when the level exceeds predefined release criteria, the control system being further operable to instruct the diversion system to deposit the feed material in a second area when the level does not exceed predefined release criteria; and a transportable trailer, the detector system, the control system, the diversion system, and the material transport mechanism being mounted on the trailer and operable thereupon.

33. The system of claim 32, wherein the detector system comprises a plurality of detector assemblies, each comprising a radiation detector.

34. The system of claim 33, wherein the radiation detector is a sodium iodide (NaI) radiation detector.

35. The system of claim 33, wherein the radiation detector is at least partially surrounded by a cylindrically shaped collimator well constructed from a material denser than lead.

36. The system of claim 32, wherein the material transport mechanism is a main conveyor traveling in a downstream direction, and the system further comprises:

a surge bin mounted above the main conveyor, the surge bin being configured to receive the feed material and deposit the feed material on the main conveyor as an initial material stream; and a screed positioned above the main conveyor at a downstream location from the surge bin, the screed being configured to reduce a thickness of the initial material stream.

37. The system of claim 36, wherein the screed is a second screed, and the system further comprises a first screed attached to the surge bin and configured to shape the feed material to produce the initial material stream.

38. The system of claim 36, further comprising:

bin level indicators attached to the surge bin and configured to detect a level of feed material in the surge bin.

39. The system of claim 32, wherein the diversion system is a reversible conveyor having a first end portion positioned adjacent the first area, and a second end portion positioned adjacent the second area, the control system is operable to instruct the reversible conveyor to travel in a first direction toward the first area to deposit the feed material in the first area, the control system is operable to instruct the reversible conveyor to travel in a second direction toward the second area to deposit the feed material in a second area, and the reversible conveyor is selectively rotatable about a center of rotation into and out of a storage position.

40. The system of claim 32, wherein the detection system is a first detection system, and the system further comprises:

a second detection system configured to detect a level of an elemental species, a selected contaminant, or a volatile organic compound.

41. The system of claim 32, further comprising a metal-detector configured to detect metal in the feed material.

42. The system of claim 32, wherein the feed material comprises at least one of soil, concrete rubble, masonry rubble, ore, ash, metallic shapes, metallic scraps, and vegetable matter.

43. The system of claim 32, wherein the material transport mechanism is a main conveyor and the system further comprises:

a surge bin pivotably mounted above the main conveyor and configured to receive the feed material and deposit the feed material on the main conveyor as an initial material stream having a thickness; and at least one height adjustment mechanism configured to rotate the surge bin relative to the main conveyor to adjust the thickness of the initial material stream.

44. The system of claim 32, wherein the material transport mechanism is a main conveyor and the system further comprises:

a surge bin mounted above the main conveyor, the surge bin having an upper opening configured to receive the feed material and a lower opening configured to deposit the feed material on the main conveyor, the surge bin being tapered outwardly from the upper opening and tapered inwardly toward the lower opening.

45. The system of claim 44, wherein the lower opening deposits the feed material on the main conveyor as an initial material stream, and the surge bin comprises a screed configured to shape the initial material stream as the initial material stream exits the surge bin.

46. A system for use with a feed material, the system comprising:

a detector system;

a control system connected to the detector system;

a diversion system connected to the control system;

a main conveyor configured to transport the feed material past the detector system and to the diversion system, the detector system being operable to detect a level of a contaminant in the feed material transported past the detector system by the main conveyor and transmit a signal to the control system indicating the level, the control system being operable to instruct the diversion system to deposit the feed material in a first area when the level exceeds predefined release criteria, the control system being further operable to instruct the diversion system to deposit the feed material in a second area when the level does not exceed predefined release criteria; and a surge bin mounted above the main conveyor, the surge bin having an upper opening configured to receive the feed material and a lower opening configured to deposit the feed material on the main conveyor, the surge bin being tapered outwardly from the upper opening and tapered inwardly toward the lower opening.

47. The system of claim 46, wherein the detector system comprises a plurality of detector assemblies, each comprising a radiation detector.

48. The system of claim 47, wherein the radiation detector is a sodium iodide (NaI) radiation detector.

49. The system of claim 47, wherein the radiation detector is at least partially surrounded by a cylindrically shaped collimator well constructed from a material denser than lead.

50. The system of claim 46, wherein the lower opening deposits the feed material on the main conveyor as an initial material stream, the initial material stream has a thickness, the main conveyor travels in a downstream direction, and the system further comprises a screed positioned above the main conveyor at a downstream location from the surge bin, the screed being configured to reduce the thickness of the initial material stream.

51. The system of claim 50, wherein the screed is a second screed, and the system further comprises a first screed attached to the surge bin and configured to shape the feed material to produce the initial material stream.

52. The system of claim 50, further comprising:

bin level indicators attached to the surge bin and configured to detect a level of feed material in the surge bin.

53. The system of claim 46, wherein the diversion system is a reversible conveyor having a first end portion positioned adjacent the first area, and a second end portion positioned adjacent the second area, the control system is operable to instruct the reversible conveyor to travel in a first direction toward the first area to deposit the feed material in the first area, the control system is operable to instruct the reversible conveyor to travel in a second direction toward the second area to deposit the feed material in a second area, and the reversible conveyor is selectively rotatable about a center of rotation into and out of a storage position.

54. The system of claim 46, wherein the detection system is a first detection system, and the system further comprises:

a second detection system configured to detect a level of an elemental species, a selected contaminant, or a volatile organic compound.

55. The system of claim 46, further comprising a metal-detector configured to detect metal in the feed material.

56. The system of claim 46, wherein the feed material comprises at least one of soil, concrete rubble, masonry rubble, ore, ash, metallic shapes, metallic scraps, and vegetable matter.

57. The system of claim 46, wherein the surge bin is pivotably mounted above the main conveyor, the lower opening deposits the feed material on the main conveyor as an initial material stream having a thickness; and the system further comprises at least one height adjustment mechanism configured to rotate the surge bin relative to the main conveyor to adjust the thickness of the initial material stream.

58. The system of claim 46, wherein the lower opening deposits the feed material on the main conveyor as an initial material stream, and the surge bin comprises a screed configured to shape the initial material stream as the initial material stream exits the surge bin.

* * * * *